US012767390B2

(12) United States Patent
Saito et al.

(10) Patent No.: US 12,767,390 B2
(45) Date of Patent: Oct. 20, 2026

(54) CAP AND TUBE CONTAINER INCLUDING SAME

(71) Applicant: TOPPAN HOLDINGS INC., Tokyo (JP)

(72) Inventors: Takeshi Saito, Tokyo (JP); Satoshi Iwata, Tokyo (JP)

(73) Assignee: TOPPAN HOLDINGS INC., Tokyo (JP)

( * ) Notice: Subject to any disclaimer, the term of this patent is extended or adjusted under 35 U.S.C. 154(b) by 0 days.

(21) Appl. No.: 18/812,926

(22) Filed: Aug. 22, 2024

(65) Prior Publication Data

US 2024/0409277 A1 Dec. 12, 2024

Related U.S. Application Data

(63) Continuation of application No. PCT/JP2023/007067, filed on Feb. 27, 2023.

(30) Foreign Application Priority Data

Feb. 28, 2022 (JP) ..... 2022-030450
May 31, 2022 (JP) ..... 2022-088842
Aug. 10, 2022 (JP) ..... 2022-127920

(51) Int. Cl.
*B65D 41/04* (2006.01)
*B65D 35/44* (2006.01)

(52) U.S. Cl.
CPC ..... *B65D 41/045* (2013.01); *B65D 35/44* (2013.01)

(58) Field of Classification Search
CPC ..... B65D 51/20; B65D 35/12; B65D 35/242; B65D 35/56; B65D 1/0462; B65D 43/00;
(Continued)

(56) References Cited

U.S. PATENT DOCUMENTS 548,661 A * 10/1895 Scales ..... B29C 51/16 156/213
1,492,836 A * 5/1924 Decker ..... B65D 35/24 132/321
(Continued)

FOREIGN PATENT DOCUMENTS

CN 2505426 Y 8/2002
CN 104411597 A 3/2015
(Continued)

OTHER PUBLICATIONS

International Searching Authority, "International Search Report," issued in connection with International Patent Application No. PCT/JP2023/007067, dated May 16, 2023.
(Continued)

*Primary Examiner* — Prince Pal
(74) *Attorney, Agent, or Firm* — Foley & Lardner LLP

(57) ABSTRACT

A cap is removably fitted over a mouth of a container and includes a molded plastic product formed of plastic and a molded paper product formed mainly of a paper biomass material and joined to the molded plastic product. The material of the molded paper product accounts for more than 50% by mass of the total materials for the cap. The molded plastic product includes a lid for opening and closing the mouth and a joining section for joining to the molded paper product. The molded paper product includes a receiving section joined to the joining section and a cylindrical portion extending from the receiving section.

4 Claims, 28 Drawing Sheets

(58) Field of Classification Search
CPC ..... B65D 5/40; B65D 77/06; B65D 35/08; B65D 35/10; B65D 35/00; B65D 35/44
USPC ..... 222/105, 106; 220/200, 254.1, 287; 215/200
See application file for complete search history.

(56) References Cited

U.S. PATENT DOCUMENTS 1,498,828 A * 6/1924 Wood ..... B65D 35/42 220/291
2,034,777 A * 3/1936 Staeheli ..... B65D 35/56 222/105
2,383,230 A * 8/1945 Voke ..... B65D 35/12 264/DIG. 41
2,471,307 A * 5/1949 Carvalho ..... B21D 51/50 493/63
2,724,863 A * 11/1955 Burman ..... B65D 35/12 264/DIG. 41
2,728,487 A * 12/1955 Bickle ..... B65D 35/02 222/105
3,016,561 A * 1/1962 Hulsh ..... B65D 35/36 401/262
3,121,906 A * 2/1964 Hulsh ..... B65D 35/36 401/262
3,144,964 A * 8/1964 Goff ..... B65D 35/12 222/106
3,160,327 A * 12/1964 Porcelli ..... B65D 47/103 220/837
3,260,777 A * 7/1966 Brandt ..... B29C 66/7234 264/262
4,069,935 A * 1/1978 Hampel ..... B65D 50/041 220/377
4,166,567 A * 9/1979 Beach, Jr. ..... B65D 5/56 229/125.21
4,319,690 A * 3/1982 Birrell ..... B65D 50/041 215/220
4,356,939 A * 11/1982 Fitte ..... B65D 47/103 222/541.9
4,440,306 A * 4/1984 Van Buskirk ..... B65D 55/02 215/230
4,493,439 A * 1/1985 Ledewitz ..... B65D 35/10 222/107
4,832,220 A * 5/1989 Quennessen ..... B65D 41/0471 215/331
4,850,506 A * 7/1989 Heaps, Jr. ..... B65D 77/061 222/105
4,948,015 A * 8/1990 Kawajiri ..... B65D 5/749 222/541.9
5,133,486 A * 7/1992 Moore ..... B65D 47/103 229/125.05
5,176,278 A * 1/1993 Quarberg ..... B65D 51/20 220/729
5,197,616 A * 3/1993 Buono ..... B65D 50/041 215/206
5,577,851 A * 11/1996 Koptis ..... B65D 35/36 401/265
5,732,722 A * 3/1998 Mortvedt ..... A61C 15/043 222/106
5,829,611 A * 11/1998 Beck ..... B65D 55/024 215/256
5,868,288 A * 2/1999 Redmond, Sr. ..... B65D 23/102 156/DIG. 27
5,979,706 A * 11/1999 Grussmark ..... B65D 51/249 222/93
6,210,766 B1 * 4/2001 McLaughlin ..... B65D 35/08 428/36.6
6,382,462 B1 * 5/2002 Ostergaard-Nielsen ..... B65D 5/749 222/541.6
6,425,492 B1 * 7/2002 Ekkert ..... B65D 41/045 220/349
6,793,101 B2 * 9/2004 Shinozaki ..... B65D 47/103 222/153.07
6,805,261 B1 * 10/2004 Laudenberg ..... B65D 75/5883 222/569
7,044,333 B2 * 5/2006 Johns ..... B65D 35/22 222/107
7,114,628 B2 * 10/2006 Guevara ..... A47J 41/0077 220/739
7,189,022 B1 * 3/2007 Greer, Jr. ..... E04F 21/02 401/266
7,222,751 B2 * 5/2007 Kerman ..... B65D 35/46 222/494
7,243,663 B1 * 7/2007 Einstein, Jr. ..... A61C 15/043 222/93
7,832,579 B2 * 11/2010 Lohrman ..... B65D 47/36 215/256
8,091,768 B2 * 1/2012 Wisecarver ..... B65D 5/60 229/125.22
8,474,665 B2 * 7/2013 Arvizu ..... B65D 47/243 222/525
8,627,968 B2 * 1/2014 Baban ..... B65D 55/022 220/255
D717,650 S * 11/2014 Tamarindo ..... D9/454
9,126,728 B1 * 9/2015 Elston ..... B65D 50/067
9,301,820 B2 * 4/2016 Hintz ..... B65D 51/28
9,598,209 B1 * 3/2017 Maldonado ..... B65D 47/122
9,867,443 B2 * 1/2018 Kim ..... A45D 34/04
10,252,847 B2 * 4/2019 Bugenske ..... B65D 47/123
D891,269 S * 7/2020 Gosling ..... D9/708
11,214,408 B2 * 1/2022 Yoshida ..... B65D 81/267
11,780,648 B2 * 10/2023 Miyoshi ..... B65D 51/22 222/107
D1,012,696 S * 1/2024 Saito ..... D9/439
12,351,379 B2 * 7/2025 Kawasaki ..... B32B 27/08
12,434,895 B2 * 10/2025 Jesberg ..... A45D 40/0068
2006/0043105 A1 * 3/2006 Pottish ..... B65D 35/08 222/92
2006/0043106 A1 * 3/2006 Pottish ..... B65D 35/44 222/92
2006/0198686 A1 * 9/2006 Hetzel ..... A45D 34/00 401/47
2007/0131712 A1 * 6/2007 Pottish ..... B65D 41/0471 222/562
2008/0041890 A1 * 2/2008 Masuda ..... B65D 35/14 222/105
2008/0311327 A1 * 12/2008 Pasbrig ..... B32B 1/08 428/36.6
2010/0084361 A1 * 4/2010 Dayton ..... B65D 15/08 493/93
2010/0102086 A1 * 4/2010 Rabinovitch ..... B65D 75/5883 222/105
2010/0140290 A1 * 6/2010 Py ..... A45D 40/26 222/105
2012/0000881 A1 * 1/2012 Sudo ..... B29C 45/1701 264/299
2013/0306676 A1 * 11/2013 Fishel ..... B67D 3/0067 222/105
2014/0008318 A1 * 1/2014 Proctor ..... B65D 23/003 215/200
2015/0028056 A1 * 1/2015 Massis ..... A23G 3/28 222/107
2015/0096957 A1 * 4/2015 Etesse ..... B65D 1/02 264/531
2015/0186770 A1 7/2015 Arai et al.
2015/0217910 A1 * 8/2015 Vogel ..... B65D 47/40 222/111
2015/0282650 A1 * 10/2015 Cusick ..... B65D 85/72 222/212
2015/0344191 A1 * 12/2015 Maurice ..... B29C 45/14008 264/138
2016/0199256 A1 * 7/2016 Donschietz ..... B65D 35/24 29/428
2016/0244222 A1 * 8/2016 Sterling ..... B65D 47/122
2016/0249726 A1 * 9/2016 Jung ..... B65D 35/38 401/261
2017/0021976 A1 * 1/2017 Wang ..... B65D 35/12

(56) References Cited

U.S. PATENT DOCUMENTS

| | | | | |
|---|---|---|---|---|
| 2017/0225843 | A1* | 8/2017 | Glaser | B65D 55/02 |
| 2017/0312994 | A1* | 11/2017 | Miller | B65D 35/08 |
| 2018/0099787 | A1* | 4/2018 | Yoshida | B32B 27/325 |
| 2019/0335877 | A1* | 11/2019 | Lee | A45D 34/04 |
| 2020/0262635 | A1* | 8/2020 | Buzzi | B65D 75/5883 |
| 2021/0086955 | A1* | 3/2021 | Charnay | B65D 41/0421 |
| 2021/0292048 | A1* | 9/2021 | Vukicevic | B65D 83/771 |
| 2021/0292049 | A1* | 9/2021 | Miyoshi | B65D 47/0804 |
| 2022/0127037 | A1* | 4/2022 | Hsu | B65D 65/466 |
| 2023/0020804 | A1* | 1/2023 | Kawasaki | B65D 75/08 |
| 2023/0126968 | A1* | 4/2023 | Giovannini | B65D 51/245 340/572.8 |
| 2023/0148732 | A1* | 5/2023 | Koh | A45D 29/18 222/107 |
| 2024/0076105 | A1* | 3/2024 | Kuo | B65D 43/022 |
| 2024/0140064 | A1* | 5/2024 | Imaizumi | B32B 27/32 |
| 2024/0400282 | A1* | 12/2024 | Morioka | B65D 23/02 |
| 2024/0409277 | A1* | 12/2024 | Saito | B65D 41/045 |

FOREIGN PATENT DOCUMENTS

| | | | |
|---|---|---|---|
| CN | 204600071 | U | 9/2015 |
| CN | 112407579 | A | 2/2021 |
| JP | S15-003033 | Y | 3/1940 |
| JP | H03-40967 | U | 4/1991 |
| JP | H10-095427 | A | 4/1998 |
| JP | H11-059707 | A | 3/1999 |
| JP | 2001-031514 | A | 2/2001 |
| JP | 2001-219921 | A | 8/2001 |
| JP | 2009-132431 | A | 6/2009 |
| JP | 2021-041934 | A | 3/2021 |
| JP | 2021-155050 | A | 10/2021 |
| JP | 2021-160727 | A | 10/2021 |

OTHER PUBLICATIONS

International Searching Authority, "Written Opinion," issued in connection with International Patent Application No. PCT/JP2023/007067, dated May 16, 2023.

European Extended Search Report issued in corresponding European Patent Application No. 23760171.1 dated May 19, 2025.

Office Action issued in corresponding Japanese Patent Application No. 2022-030450 dated Nov. 4, 2025.

Office Action issued in corresponding Chinese Patent Application No. 202380022927.2 dated Apr. 16, 2026.

* cited by examiner

CAP AND TUBE CONTAINER INCLUDING SAME

CROSS-REFERENCE TO RELATED PATENT APPLICATIONS

This application is a continuation application filed under 35 U.S.C. § 111(a) claiming the benefit under 35 U.S.C. §§ 120 and 365(c) of International Patent Application No. PCT/JP2023/007067, filed on Feb. 27, 2023, which is based upon and claims the benefit to Japanese Patent Application No. 2022-030450, filed on Feb. 28, 2022; to Japanese Patent Application No. 2022-088842, filed on May 31, 2022; and Japanese Patent Application No. 2022-127920, filed on Aug. 10, 2022; the disclosures of all which are incorporated herein by reference in their entirety.

TECHNICAL FIELD

The present invention relates to a cap that is fitted over the mouth of a container such as a tube, formed mainly of a molded paper product, and capable of meeting a target for reducing disposable plastic products.

BACKGROUND

Although currently commercialized light and lidded containers are mainly made from resin, paper containers are needed for eco-friendliness (to reduce environmental problems or environmental loads).

A hinged cap including biomass-derived polyethylene has been conventionally known (paragraph and FIG. 6 in PTL 1).

The amount of the biomass-derived polyethylene is preferably 10% by mass or more in the raw material monomers, and more preferably 30% by mass or more.

A known molded pulp product (paragraph and FIGS. 1 and 3 in PTL 2) includes a molded product fitted over an opening in a molded pulp member and having a thread on the outer surface of the molded product, and a lid with a threaded groove formed in the inner surface of the lid may be fitted onto the container body by screwing the threaded groove onto the thread.

[Citation List] [Patent Literatures] [PTL 1] JP 2021-160727 A; [PTL 2] JP 2001-219921 A.

SUMMARY OF THE INVENTION

Technical Problem

Although biomass-derived polyethylene is used, the conventional cap described in PTL 1 above is entirely made from plastic and thus insufficient to meet targets for reducing disposable plastic products.

For the conventional molded pulp product described in PTL 2 above, because the threaded groove in the lid is formed by pulp molding, it is difficult to precisely machine the threaded groove and also retain the sealing properties of the container.

In view of such circumstances, the present invention has been made to solve the known problems and aimed at better meeting targets for reducing disposable plastic products by using a molded plastic product only to the extent necessary for the use of a cap and mainly and preferentially using a molded paper product.

An object of the present invention is to provide a cap including a molded plastic product to the extent necessary for the use of the cap to enable precision machining of a threaded groove. The cap can improve the sealing properties and regulate the associated increase in the ratio of plastic as well as resist becoming unusable even after repeated use.

Solution to Problem

A cap according to an aspect of the present invention is a cap fittable over the mouth of a container and including: a molded plastic product formed of plastic; and a molded paper product formed mainly of a paper biomass material and joined to the molded plastic product, characterized in that the material of the molded paper product accounts for more than 50% by mass of the total materials for the cap.

The cap according to the aspect of the present invention is characterized in that the molded plastic product includes a lid for opening and closing the mouth and a joining section for joining to the molded paper product.

The cap according to the aspect of the present invention is characterized by a receiving section joined to the joining section and a cylindrical portion extending from the receiving section.

The cap according to the aspect of the present invention is characterized in that the amount of biomass-derived biomass resin in the molded plastic product is more than 50% by mass in the raw material monomers.

The cap according to the aspect of the present invention is characterized in that the joining section is a regular polygonal plate, the receiving section has the shape of the same regular polygon as the joining section, and the cylindrical portion has the shape of a polygonal prism composed of the receiving section and side plates rising from the sides of the regular polygon.

The cap according to the aspect of the present invention is characterized in that the lid is cylindrical with an internal thread cut in its inner surface to correspond to an external thread cut on the outer surface of the mouth or cylindrical with an external thread cut on its outer surface to correspond to an internal thread cut in the inner surface of the mouth, and the lid is bonded to the center of the joining section with its axis extending in a direction orthogonal to the surface of the joining section.

The cap according to the aspect of the present invention is characterized in that the joining section includes a torque distributor that is located on the end surface abutting on the side plates of the cylindrical portion, extends toward the distal end of the cylindrical portion along the inner surface of the side plates, and distributes the rotational torque generated by the rotation of the cylindrical portion.

The cap according to the aspect of the present invention is characterized in that the joining section and the receiving section have a reservoir between them for holding adhesive or glue.

The cap according to the aspect of the present invention is characterized in that the joining section includes energy directors for ultrasonic welding arranged in a radial, circular, or polygonal pattern with respect to the center of the joining section.

The cap according to the aspect of the present invention is a cap including a molded plastic product and a molded paper product with the molded plastic product engaged inside through an opening, characterized by a fall prevention section that prevents the molded plastic product from falling through the opening.

The cap according to the aspect of the present invention is characterized in that the material of the molded paper product accounts for more than 50% by mass of the total materials for the cap.

The cap according to the aspect of the present invention is characterized in that the molded paper product includes a cylindrical portion having the opening at one end, the molded plastic product includes a lid for opening and closing the mouth of the container to be fitted with the cap and a joining section for joining to the molded paper product, and the fall prevention section is located on the outer surface of the joining section facing the inner surface of the cylindrical portion and protrudes toward the inner surface of the cylindrical portion.

The cap according to the aspect of the present invention is characterized in that the cylindrical portion has a mesh-like uneven section on its inner surface.

The cap according to the aspect of the present invention is characterized in that the protrusions are wedge-shaped and widen gradually toward the opening.

The cap according to the aspect of the present invention is characterized in that the protrusions extend obliquely outward from the outer surface of the joining section toward the opening.

The cap according to the aspect of the present invention is characterized in that the inner surface of the cylindrical portion is polygonal or circular in plan view, the joining section is a polygonal or circular plate, and the protrusions are formed at regular intervals around the circumference of the outer surface of the joining section.

The cap according to the aspect of the present invention is characterized in that the protrusions each include a thin hinge between the protrusion and the joining section.

The cap according to the aspect of the present invention is characterized in that the multiple protrusions are formed at regular intervals around the circumference of the joining section and include connectors for connecting adjacent protrusions in the form of a skirt in a circumferential direction of the joining section.

The cap according to the aspect of the present invention is characterized in that the molded paper product includes a cylindrical portion having the opening at one end and a top portion covering the other end of the cylindrical portion, and the molded plastic product includes a lid for opening and closing the mouth and a joining section for joining to the molded paper product. The cylindrical portion has an open-top and open-bottom hollow cylindrical paper tube fitted on its inner surface and serving as the fall prevention section. The paper tube has an outer surface in contact with the inner surface of the cylindrical portion to provide frictional resistance for preventing axial movement, with the peripheral edge of the joining section positioned between one end surface of the paper tube and the top portion.

The cap according to the aspect of the present invention is characterized in that the joining section includes, on the surface facing away from the lid, a spike that bites into the top portion.

The cap according to the aspect of the present invention is characterized in that the joining section is sandwiched between the top portion and the end surface of the paper tube.

The cap according to the aspect of the present invention is characterized in that the paper tube is fixed to the inner surface of the cylindrical portion in a position that allows the joining section to move in the axial direction of the cylindrical portion between the top portion and the end surface of the paper tube. The top portion and the joining section facing the top portion respectively have a recess and a projection that fit together. The projection has a height such that the projection is completely out of the recess in the position where the joining section has moved furthest toward the paper tube.

The cap according to the aspect of the present invention is a cap including a molded plastic product and a molded paper product with the molded plastic product engaged inside through an opening, characterized in that the molded paper product includes a cylindrical portion having the opening at one end, a top portion covering the other end of the cylindrical portion, and a cylindrical paper tube located on the inner surface of the cylindrical portion and having an outer diameter equal to or smaller than the inner diameter of the cylindrical portion, with the outside of the paper tube overlapping the inside of the cylindrical portion. The paper tube has a wall thickness equal to or greater than the wall thickness of the cylindrical portion.

The cap according to the aspect of the present invention is a cap with a molded plastic product engaged inside a molded paper product having an opening, characterized in that the molded plastic product and the molded paper product are welded to each other with a part of the molded plastic product embedded in the molded paper product.

A tube container with the cap according to the aspect of the present invention includes: a tubular body with a first end blocked; and an outlet attached to a second end of the body, characterized in that the body is formed mainly of paper.

The tube container according to the aspect of the present invention is characterized in that the outlet includes a first cylindrical portion having a cylindrical shape and including a flange at one axial end, and a flat plate having an annular flat shape with an opening of substantially the same shape as a cross-section of the first cylindrical portion and having one surface hermetically bonded to the flange of the first cylindrical portion with the first cylindrical portion extending through the opening. The part of the body in a predetermined range from the other end is hermetically bonded to the other surface of the flat plate, and the first cylindrical portion, the flat plate, and the body are composed of sheets formed mainly of paper.

Advantageous Effects of the Invention

The cap according to the aspect of the present invention can better meet targets for reducing disposable plastic products by using a molded plastic product only to the extent necessary for the use of the cap and mainly and preferentially using a molded paper product.

BRIEF DESCRIPTION OF THE DRAWINGS

FIG. 9A is a plan view of a molded plastic product according to the fourth embodiment, whereas FIG. 9B is a plan view corresponding to FIG. 9A according to the fifth embodiment.

FIG. 29A illustrates a state in which a molded plastic product is locked in a molded paper product to allow these products to rotate together, whereas FIG. 29B illustrates a state in which the lock is released to allow the molded plastic product to rotate freely inside the molded paper product.

DETAILED DESCRIPTION

Embodiments

Embodiments of the present invention will now be described with reference to the drawings.

It should be noted that the drawings are schematic only, and the relationship between the thickness and the planar dimensions and the thickness ratio between components are different from actual ones. The relationship or ratio between dimensions may also differ between drawings. The embodiments described below are examples for embodying the technical idea of the present invention, and the technical idea of the present invention should not be construed as limiting the materials, the shapes, and the structures of components to those described later. The technical idea of the present invention may be modified variously within the technical scope defined by the claims.

(Cap 10)

Figure 1:
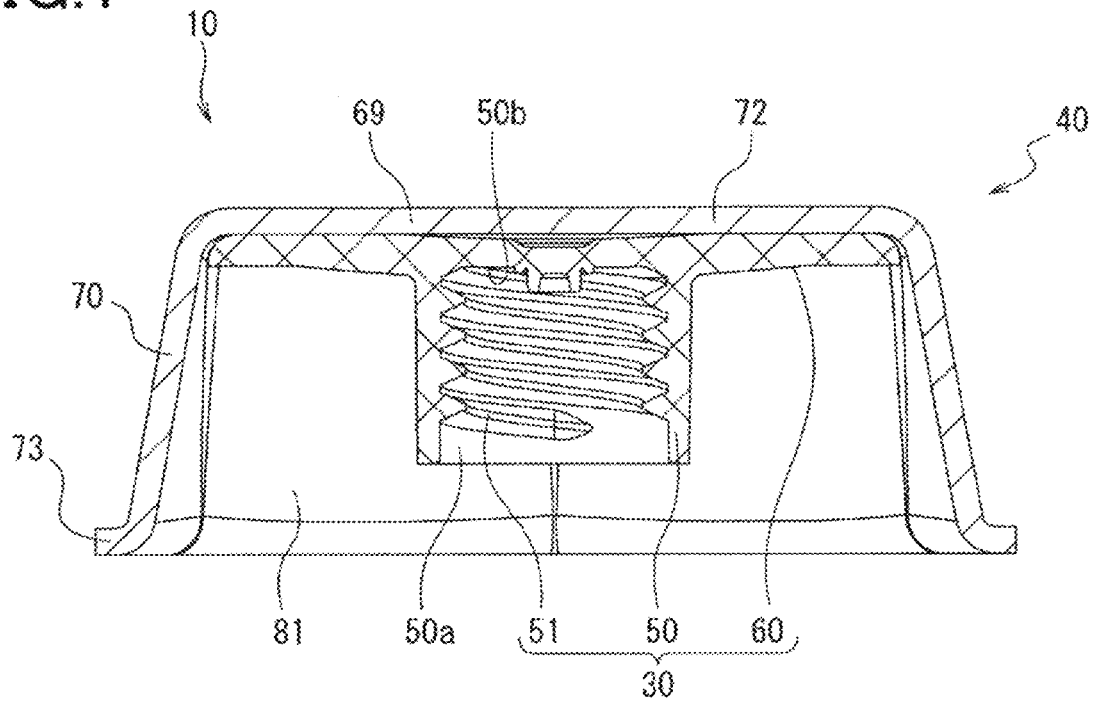
FIG. 1 is a longitudinal sectional view of a cap according to a first embodiment of the present invention.
Figure 3:
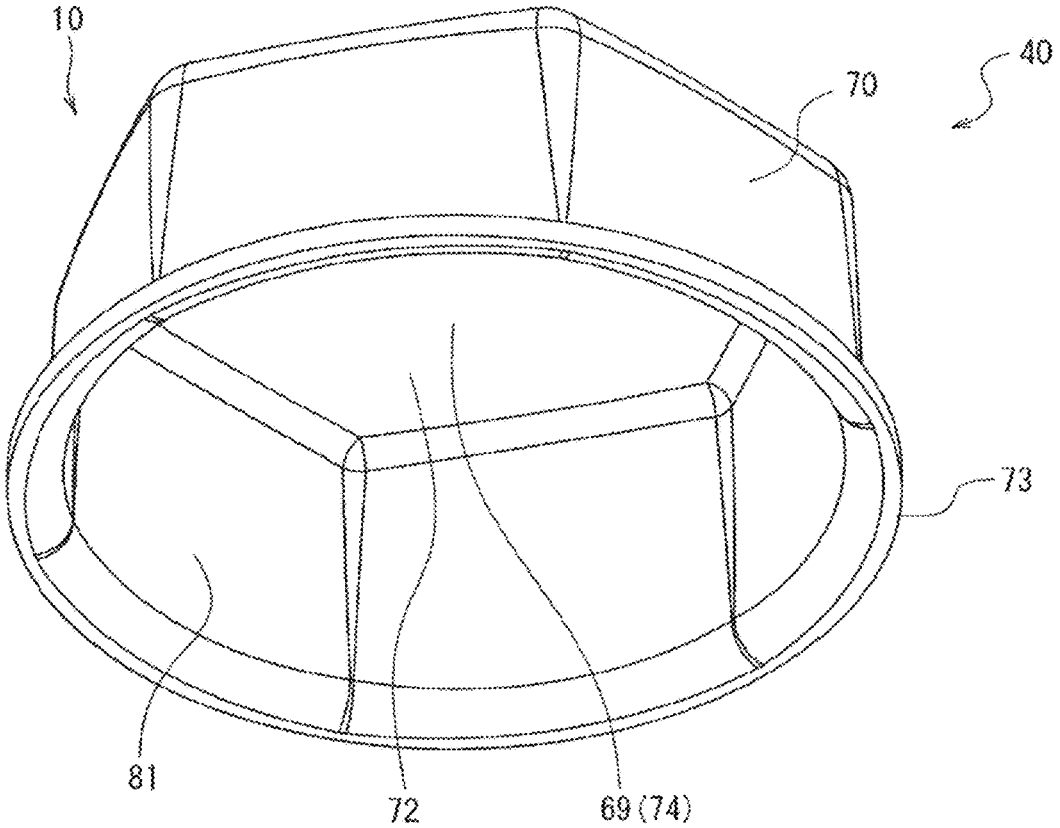
FIG. 3 is an exploded perspective view of the cap according to the first embodiment of the present invention.
Figure 3:
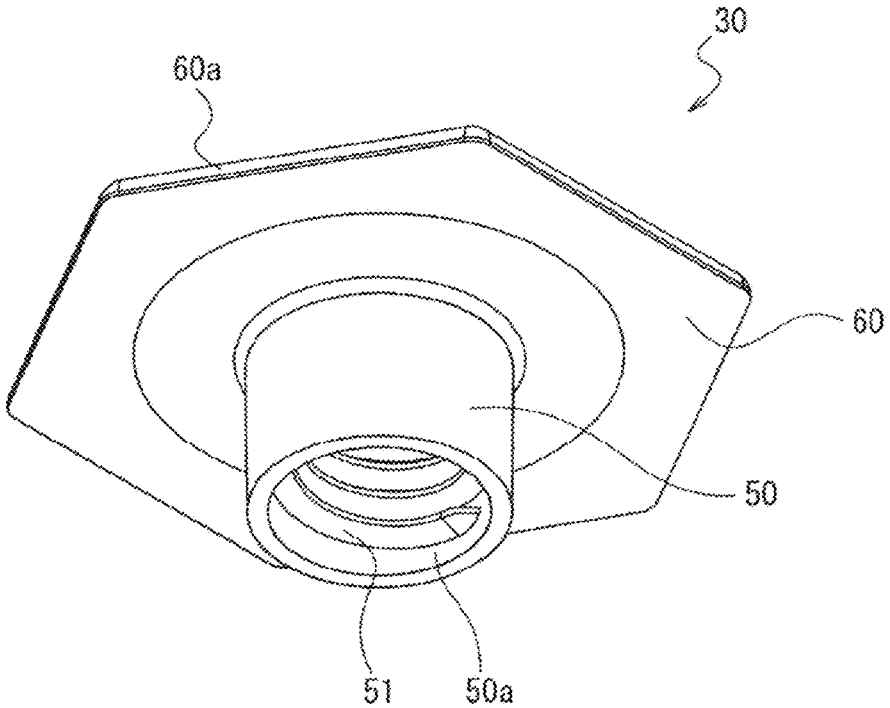

As illustrated in FIGS. 1 and 3, a cap 10 in the embodiments described below mainly includes a molded plastic product 30 formed of plastic and a molded paper product 40 formed mainly of a paper biomass material and joined to the molded plastic product 30.

(Container 20)

Figure 2:
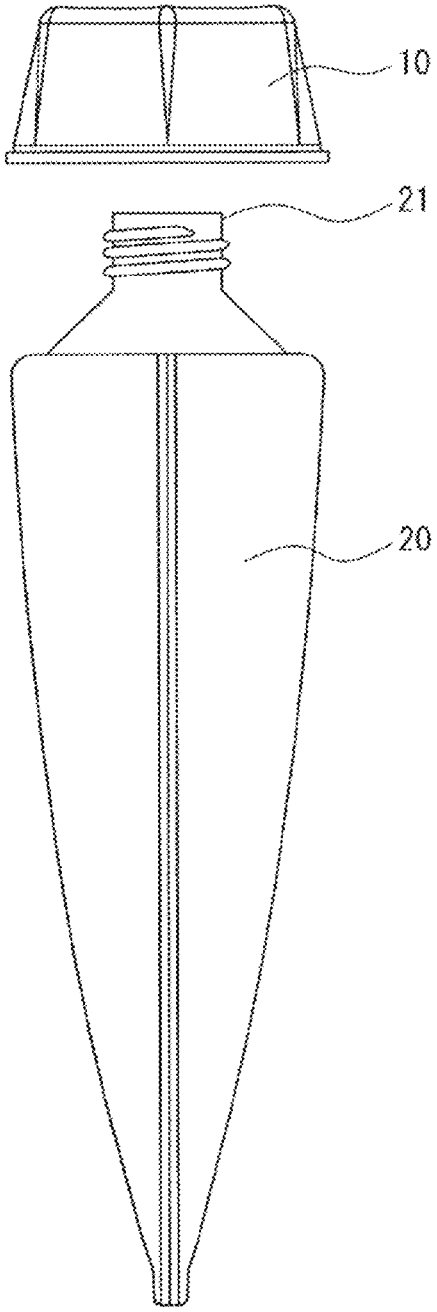
FIG. 2 is a side view of the cap and a container according to the first embodiment of the present invention.

As illustrated in FIG. 2, a container 20 in the embodiments described below is, for example, tubular and has a mouth 21 through which the contents of the container 20 can be extracted. The cap 10 is removably fitted over the mouth 21 of the container 20.

The mouth 21 has an external thread formed on its outside to allow the cap 10 to be attached and detached. The mouth 21 may have an internal thread formed inside.

Although the container 20 is illustrated as a tubular container, the container 20 is not limited to a tube but may be nontubular.

The container 20 may be used for any purpose, and examples of the contents include shampoo, rinse, body wash, face wash, toothpaste, detergent, bleach, softener, drink, food, and engine oil.

(Molded Plastic Product 30)

The molded plastic product 30 in the embodiments described below is a plastic injection molded article.

The plastic may be of any type, such as polyethylene, polypropylene, polyvinyl chloride, or polystyrene.

In the molded plastic product 30, the amount of biomass-derived resin in the raw material monomers is more than 50% by mass, preferably 60% by mass or more, and more preferably 80% by mass or more.

The biomass-derived resin may be, for example, partially or wholly biomass polyethylene, biomass polypropylene, or biomass polyethylene terephthalate made by using biomass-derived ethylene or propylene as a raw material.

The molded plastic product 30 at least has the functions of the cap 10 to, for example, open and close the mouth 21 of the container 20 and provide barrier properties and hermeticity.

(Each Part of Molded Plastic Product 30)

As illustrated in FIGS. 1, 3, 4, and 6, the molded plastic product 30 in the embodiments described below mainly includes the following parts. Each part of the molded plastic product 30 will be described in detail later.

(1) Lid 50

(2) Joining Section 60

(Molded Paper Product 40)

The molded paper product 40 in the embodiments described below is, for example, a product of molded pulp.

The molded pulp refers to a material made by dissolving and entangling vegetable fibers (mainly, used paper) in water, straining the resultant fibers through a mold, and then drying the fibers.

The molded paper product 40 is not limited to molded pulp but may be produced by a paper material injection molding method for producing a 3D structure by injection molding from molding materials containing pulp and starch as main components, a method for producing a cardboard tube, a production method with a molded material such as a cup or a container, or an insert injection technique for producing a single piece by injecting paper blanks into an injection mold.

The molded paper product 40 is produced with a paper-based biomass material, and this material accounts for more than 50% by mass of the total materials for the cap 10, preferably 60% by mass or more, and more preferably 80% by mass or more.

(Biomass)

Biomass refers to renewable, organic resources of biological origin, excluding fossil resources.

Biomass elements are classified into (1) waste biomass, (2) unused biomass, and (3) resource crops, depending on the state of their existence.

Examples of waste biomass include waste paper, food waste, and black liquor (pulp factory liquid waste).

Examples of unused biomass include rice straw, wheat straw, rice husks, and forest-thinning waste.

Examples of resource crops include carbohydrate resources (e.g., sugarcane), starch resources (e.g., corn), oil and fat resources (e.g., rapeseed), willow, poplar, and switchgrass.

The thickness of the molded paper product 40 is, for example, 0.5 mm to 5.0 mm for a rough mold and preferably 0.8 to 5 mm for a fine product of molded pulp.

(Each Part of Molded Paper Product 40)

As illustrated in FIGS. 1, 3, 5, and 6, the molded paper product 40 mainly includes the following parts. Each part of the molded paper product 40 will be described in detail later.

(1) Top Portion 72

(2) Cylindrical Portion 70

(Lid 50)

As illustrated in FIGS. 1 and 3, the lid 50 opens and closes the mouth 21 of the container 20.

The lid 50 has a cylindrical shape, such as a tubular shape. The lid 50 has an opening 50*a* at the distal end into which the mouth 21 of the container 20 can be inserted, and a top surface 50*b* facing the opening 50*a* and covered by the top portion 72 described later. The top surface 50*b* of the lid 50 comes into contact with the mouth 21 inserted in the opening 50*a* to block the mouth 21.

The lid 50 has a threaded portion 51 in its inner surface as an internal thread corresponding to the external thread formed on the outer surface of the mouth 21.

Although the lid 50 has the threaded portion 51 formed in its inner surface as an internal thread, this is not restrictive. For example, for a container with a large-diameter mouth, the mouth 21 may have an internal thread formed in its inner surface, and the lid 50 may have the corresponding external thread formed on its outer surface.

The lid 50 is bonded to the center of the joining section 60 with the axial direction orthogonal to the surface of the joining section 60.

(Joining Section 60)

Figure 4:
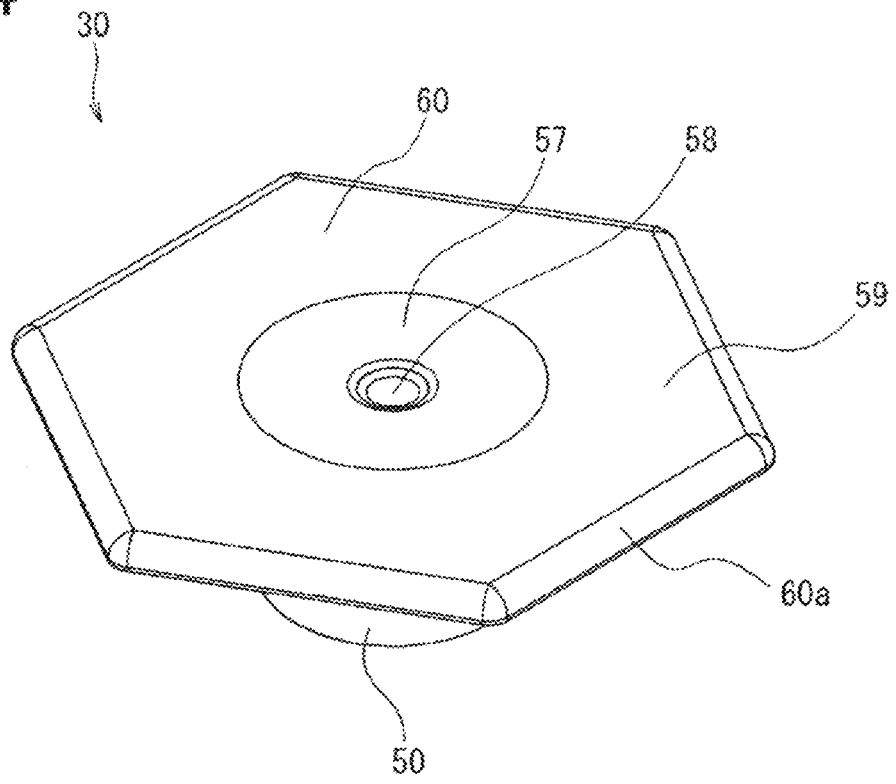
FIG. 4 is a perspective view of a molded plastic product illustrated in FIG. 3.

As illustrated in FIGS. 1, 3, and 4, the joining section 60 is bonded to the end of the lid 50 opposite the end that opens and closes the mouth 21 and used to join to the molded paper product 40.

The joining section 60 is a regular polygonal plate, such as a regular hexagonal plate.

Although the regular polygon of the joining section 60 is illustrated as a regular hexagon, the shape is not limited to a regular hexagon but may be, for example, a regular triangle, a square, a regular heptagon, or any regular polygon with more sides.

The joining section 60 has, in its surface 59, a half-round recess 58 positioned at the center and a slope 57 surrounding the recess 58 and declining toward the recess 58. The recess 58 and the slope 57 are provided to facilitate the release of air that has entered when the joining section 60 and a receiving section 69 described below are joined together with an adhesive or a glue.

(Receiving Section 69)

Figure 5:
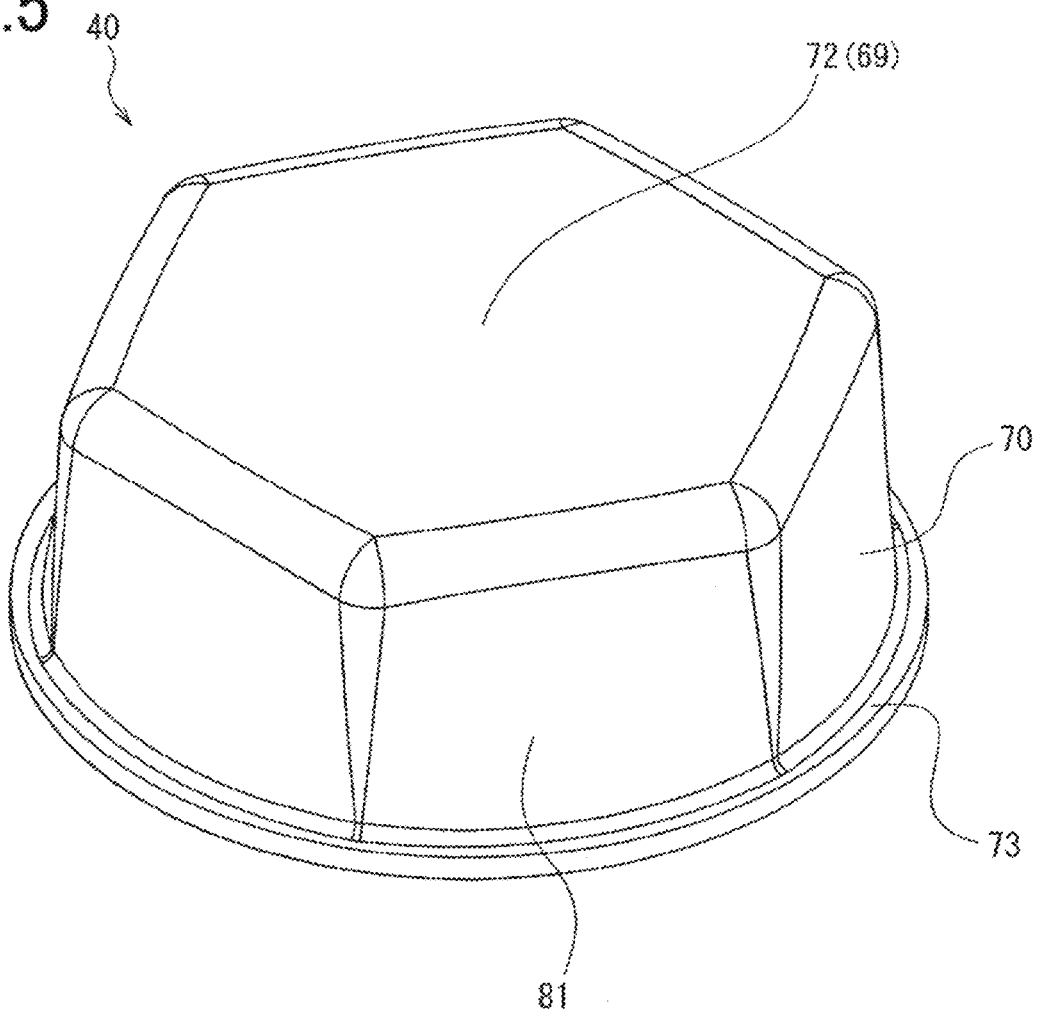
FIG. 5 is a perspective view of a molded paper product illustrated in FIG. 3.
Figure 6:
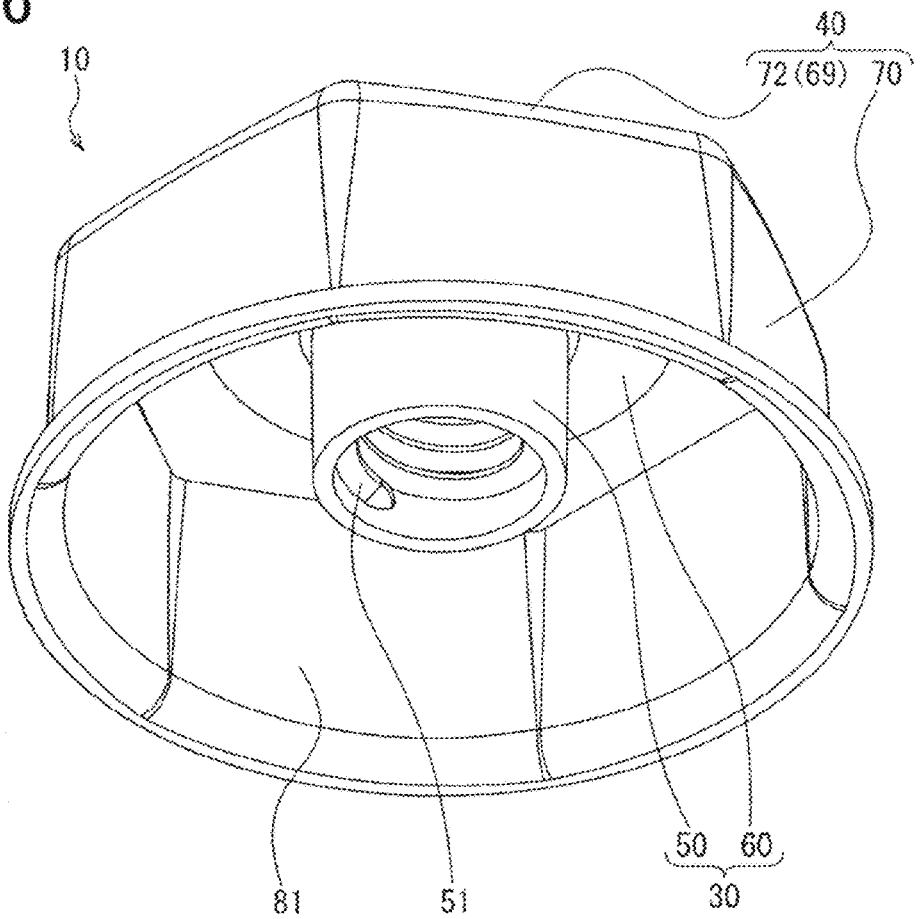
FIG. 6 is a perspective view of the cap illustrated in FIG. 1.

As illustrated in FIGS. 1, 5, and 6, the receiving section 69 is a plate joined with the part of the joining section 60 facing away from the lid 50.

The receiving section 69 has the shape of the same regular polygon as the joining section 60, such as the same regular hexagon as the joining section 60.

Although the shape of the receiving section 69 is illustrated as the same regular hexagon as the joining section 60, the shape is not limited to the regular hexagon but may be, for example, a regular triangle, a square, a regular heptagon, or any regular polygon with more sides, similarly to the joining section 60.

(Cylindrical Portion 70)

As illustrated in FIGS. 1, 5, and 6, the cylindrical portion 70 entirely has the shape of a cap with the bottom surface having an opening 71 and the top surface covered by the top portion 72 and extends from the entire outer periphery of the receiving section 69, which is the top portion 72, in a manner that surrounds the molded plastic product 30. When the lid 50 closes the mouth 21, the distal end of the extension is in contact with the container 20 to conceal the mouth 21 of the container 20.

The cylindrical portion 70 has the shape of a polygonal prism composed of side plates 81 rising from the sides of the regular polygon of the receiving section 69, such as a regular hexagonal prism.

The cylindrical portion 70 has a reinforcing flange 73 on its distal end to encircle the edge of the regular hexagon.

The flange 73 is circular to improve the rigidity of the cylindrical portion 70.

(Assembly of Cap 10)

The assembly of the cap 10 will now be described with reference to FIGS. 1 and 6.

For the cap 10 with the above-described structure, the joining section 60 of the molded plastic product 30 and the receiving section 69 of the molded paper product 40 are joined together with, for example, a hot-melt adhesive.

Although a hot-melt adhesive is used as an example, the joining section 60 and the receiving section 69 may be, for example, (1) joined together with an adhesive and (2) welded together by ultrasonics or integrated by physical engagement.

With the outside corners of the joining section 60 and the inside corners of the receiving section 69 in contact with each other, when the molded paper product 40 is rotated, the molded plastic product 30 rotates together to open or close the mouth 21 of the container 20.

Figure 7:
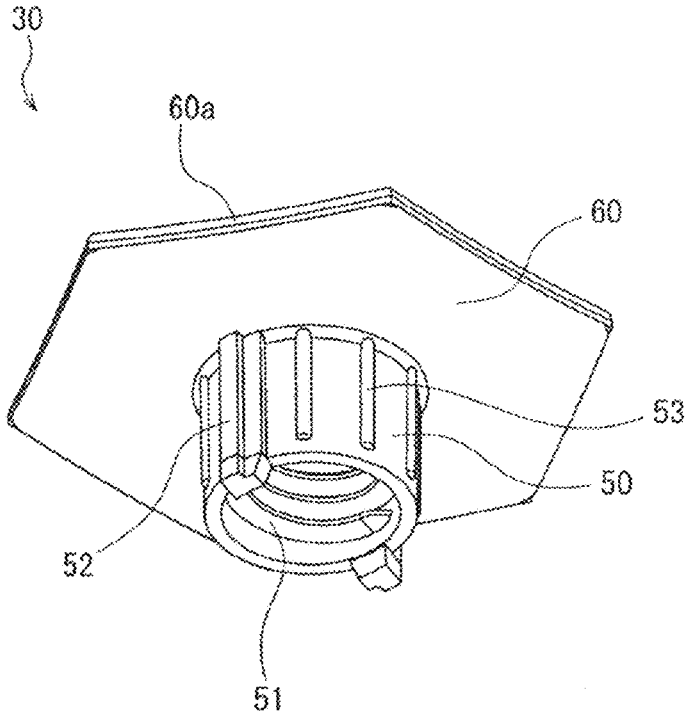
FIG. 7 is a perspective view of a molded plastic product according to a second embodiment of the present invention.

(Description of Molded Plastic Product 30 in Second Embodiment with FIG. 7)

A molded plastic product 30 according to a second embodiment will now be described with reference to FIG. 7.

The present embodiment is characterized in that the molded plastic product 30 includes stoppers 52 and ribs 53.

The stoppers 52 are a pair of portions at 180-degree intervals, protruding from the outside of the lid 50. When the lid 50 is rotated, the stoppers 52 come into contact with the mouth 21 of the container 20 to restrict the rotation angle of the lid 50 to 180 degrees.

Although the stoppers 52 restrict the rotation angle of the lid 50 to 180 degrees, the rotation angle of the lid 50 may be, for example, restricted to less than 180 degrees.

The ribs 53 are a plurality of portions protruding from the outside of the lid 50 and elongated in its height direction. The ribs 53 serve as reinforcements and as a rotation stop when a screw core is removed.

Figure 8:
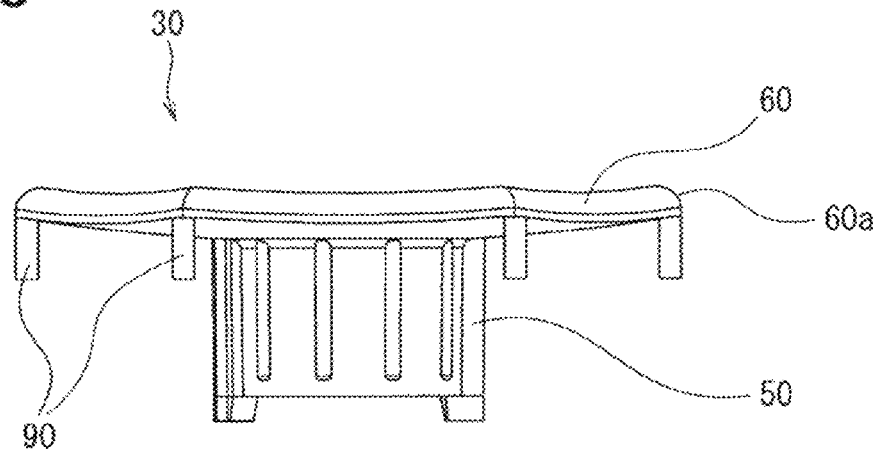
FIG. 8 is a side view of a molded plastic product according to a third embodiment of the present invention.

(Description of Molded Plastic Product 30 in Third Embodiment with FIG. 8)

A molded plastic product 30 according to a third embodiment will now be described with reference to FIG. 8.

The present embodiment is characterized in that the joining section 60 of the molded plastic product 30 includes a torque distributor 90.

The torque distributor 90 is located on an end surface 60*a* included in the joining section 60 and abutting on the side plates 81 of the cylindrical portion 70, extends toward the distal end of the cylindrical portion 70 along the inner surfaces of the side plates 81, and distributes the rotational torque generated by the rotation of the cylindrical portion 70.

The torque distributor 90 includes pieces elongated from the end surface 60*a* of the joining section 60. The pieces extend along the inner surface of the cylindrical portion 70 and are separated from each other along the outline of the joining section 60.

With the joining section 60 joined to the receiving section 69, the torque distributor 90 is in contact with the inner surface of the cylindrical portion 70 together with the end surface 60*a* of the cylindrical portion 60. This structure allows the rotational torque generated by the rotation of the cylindrical portion 70 to be distributed to the end surface 60*a* of the joining section 60 and the torque distributor 90.

In the present embodiment, the torque distributor 90 can distribute the rotational torque generated by the rotation of the cylindrical portion 70 as described above.

In the present embodiment, the torque distributor 90 is formed as pieces, and the pieces are separated from each other, allowing increase in the weight of the molded plastic product 30 to be suppressed compared with a case in which the thickness of the overall joining section 60 is increased.

Figure 9A:
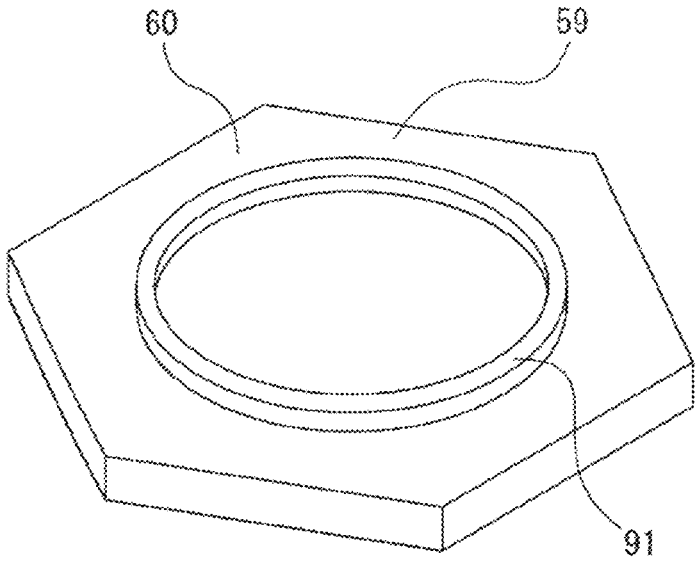
FIGS. 9A and 9B are diagrams according to fourth and fifth embodiments of the present invention.
Figure 9B:
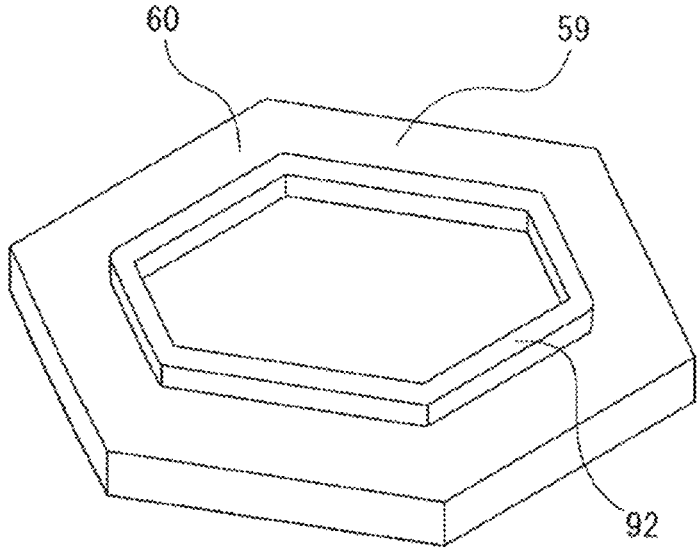

(Description of Molded Plastic Products 30 in Fourth and Fifth Embodiments with FIGS. 9A and 9B)

Molded plastic products 30 according to fourth and fifth embodiments will now be described with reference to FIGS. 9A and 9B.

The present embodiment is characterized in that the joining section 60 and the receiving section 69 have a reservoir 91 or 92 between them for holding adhesive or glue.

As illustrated in FIG. 9A, the reservoir 91 has a circular shape and protrudes from the surface of the joining section 60. The reservoir 91 has the center of the circle positioned at the center of the joining section 60.

As illustrated in FIG. 9B, the reservoir 92 has a polygonal shape such as a regular hexagon smaller than the joining section 60 and protrudes from the surface of the joining section 60. The reservoir 92 has the center of the regular hexagon positioned at the center of the joining section 60. Although the reservoir 92 is illustrated as the regular hexagon, the shape is not limited to the regular hexagon but may be, for example, a regular triangle, a square, a regular pentagon, a regular heptagon, or any regular polygon with more sides.

In the present embodiment, the reservoir 91 or 92 can store any excess of adhesive or glue to prevent the adhesive or glue from leaking to visible parts, or bleeding, and improve the appearance of the cap 10.

Figure 10:
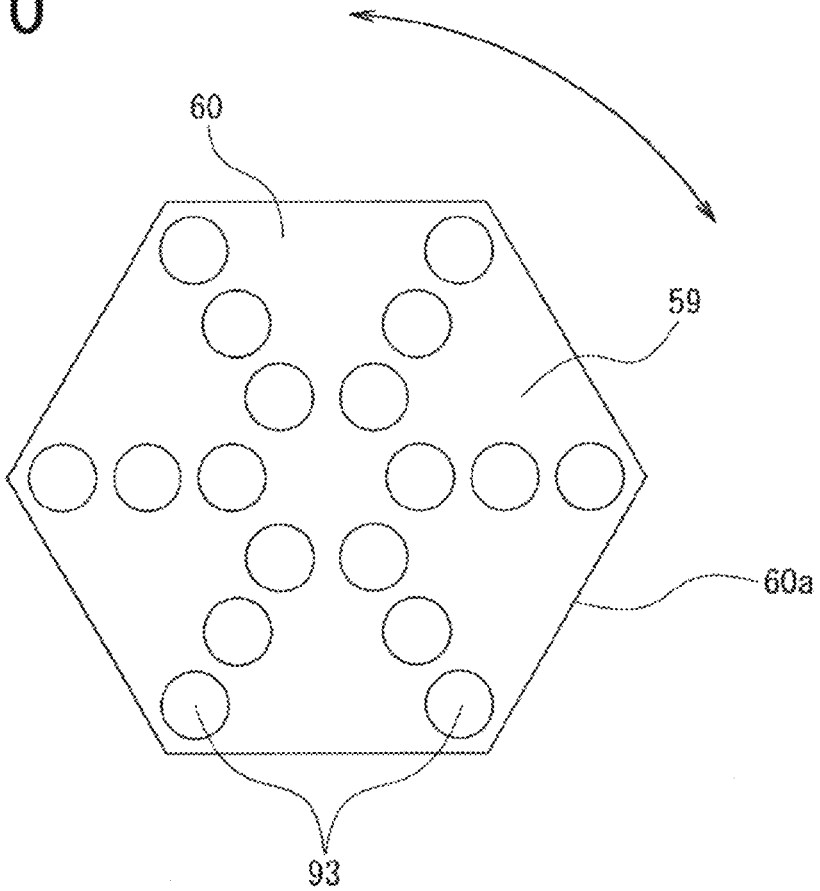
FIG. 10 is a plan view of a molded plastic product according to a sixth embodiment of the present invention.

(Description of Molded Plastic Product 30 in Sixth Embodiment with FIG. 10)

A molded plastic product 30 according to a sixth embodiment will now be described with reference to FIG. 10.

The present embodiment is characterized in that the joining section 60 includes energy directors for ultrasonic welding (hereinafter, referred to as the EDs) 93 arranged in a radial, circular, or polygonal pattern with respect to the center of the joining section 60.

The EDs 93 are located on the surface of the joining section 60 and composed of a plurality of projections serving as the EDs 93 and arranged at predetermined intervals on straight lines extending radially from the center to the end surface 60*a*.

The projections are subjected to concentrated transmission of ultrasonic vibration to generate localized frictional heat, which can partially melt the projections to firmly bond the joining section 60 to the receiving section 69.

Although illustrated as the projections, the EDs 93 are not limited to projections but may be convex.

The EDs 93 may also be arranged in a circular or a polygonal pattern, such as a regular hexagonal pattern.

In the present embodiment, the appropriately arranged EDs 93 enable the joining section 60 and the receiving section 69 to be firmly bonded together.

(Other Embodiments of Cap 10)

Although the joining section 60 of the molded plastic product 30 and the receiving section 69 of the molded paper product 40 are polygonal, this is not restrictive; for example, an eyelet structure may be used to prevent the molded plastic product 30 from detaching, or the bond strength in the rotational direction may be increased by heat-sealing or applying a PE film to the surface of the molded paper product 40.

For example, the joining section 60 of the molded plastic product 30 may be a cross-shaped protrusion, and the receiving section 69 of the molded paper product 40 may have a radial groove into which the cross-shaped protrusion fits to increase the bond strength in the rotational direction.

The receiving section 69 of the molded paper product 40 may have a double wall structure, into which the joining section 60 of the molded plastic product 30 may be fitted.

The molded paper product 40 may be, for example, a paper-cup-like product, a structure with a cardboard tube, an assembly box structure, or a press-formed product. For the molded pulp, the bonding strength of the surface material may also be improved or adjusted by various methods such as addition of adhesion aids such as a sizing agent to slurry water, surface coating, or film pulling.

Features and Advantageous Effects of Embodiments

The features and advantageous effects of the above embodiments are described below.

First Feature

According to a first feature, for example, as illustrated in FIGS. 1 and 3 to 6, the cap 10 detachably fitted over the mouth 21 of the container 20 includes the molded plastic product 30 formed of plastic and the molded paper product 40 formed mainly of a paper biomass material and jointed to the molded plastic product 30.

According to the first feature, the material of the molded paper product 40 accounts for more than 50% by mass of the total materials for the cap 10.

Advantageous Effects of First Feature

According to the first feature, targets for reducing disposable plastic products can be better met by using the molded plastic product 30 only to the extent necessary for the use of the cap 10 and mainly and preferentially using the molded paper product 40.

According to the first feature, the molded paper product 40, which is formed mainly of a paper biomass material, is carbon-neutral in terms of carbon dioxide emissions and contributes to reduction in statistical carbon dioxide emissions even when the cap 10 is recovered as waste and incinerated.

Furthermore, according to the first feature, the cap 10 formed mainly of the molded paper product 40 allows the container 20 and the cap 10 to be disposed of in their entirety even in a region where the paper container 20 with a plastic cap should be disposed of with the cap separated.

According to the first feature, for example, after being compressed and reduced in volume, the container 20 without the cap 10 may recover its shape and swell; however, the use of the cap 10 allows shape recovery to be reduced by fitting the cap 10 after a reduction in volume, and contributes to reduction in the volume of waste.

According to the first feature, since the molded paper product 40 is formed of paper, the surface may be used as a designed surface to improve design quality.

Assuming an outer diameter of @35 mm for the mouth 21 of the container 20, when a plastic article having the same shape as the cap 10 was injection molded, the plastic article weighed about 3 g. However, when the molded plastic product 30 and the molded paper product 40 were produced individually as in the present embodiment, the molded plastic product 30 weighed about 1 g, while the molded paper product 40 weighed about 2 g.

Second Feature

According to a second feature, the molded plastic product 30 includes the lid 50 for opening and closing the mouth 21 and the joining section 60 for joining to the molded paper product 40.

Third Feature

According to a third feature, the molded paper product 40 includes the receiving section 69 joined to the joining section 60 and the cylindrical portion 70 extending from the receiving section 69.

Fourth Feature

According to a fourth feature, the amount of biomass-derived biomass resin in the molded plastic product 30 is more than 50% by mass in the raw material monomers.

Advantageous Effects of Fourth Feature

According to the fourth feature, the use of fossil raw materials for the entire cap 10 can be reduced to lessen the environmental impact.

Fifth Feature

According to a fifth feature, for example, as illustrated in FIGS. 1 and 3 to 6, the joining section 60 is a regular polygonal plate, and the receiving section 69 has the shape of the same regular polygon as the joining section 60, and the cap has the shape of a polygonal prism composed of the receiving section 69 and the side plates 81 standing on the sides of the regular polygon.

Advantageous Effects of Fifth Feature

According to the fifth feature, when the molded paper product 40 rotates, the molded plastic product 30 rotates together to prevent the joining section 60 and the receiving section 69 from separating from each other.

Sixth Feature

According to a sixth feature, for example, as illustrated in FIGS. 1 and 3 to 6, the lid 50 is cylindrical with an internal thread (e.g., the threaded portion 51) cut in its inner surface to correspond to an external thread cut on the outer surface of the mouth 21 or cylindrical with an external thread cut on its outer surface to correspond to an internal thread cut in the inner surface of the mouth 21, and the lid 50 is bonded to the center of the joining section 60 with its axis extending in a direction orthogonal to the surface of the joining section 60.

Advantageous Effects of Sixth Feature

According to the sixth feature, when the lid 50 is bonded to the center of the joining section 60 with the axis extending in a direction orthogonal to the surface of the joining section 60, the molded plastic product 30 can be smoothly rotated through the cylindrical portion 70 of the molded paper product 40 and also smoothly attached to or detached from the mouth 21 of the container 20.

Seventh Feature

According to a seventh feature, for example, as illustrated in FIG. 8, the joining section 60 includes the torque distributor 90 that is located on the end surface abutting on the side plates 81 of the cylindrical portion 70, extends toward the distal end of the cylindrical portion 70 along the inner surfaces of the side plates 81, and distributes the rotational torque generated by the rotation of the cylindrical portion 70.

Advantageous Effects of Seventh Feature

According to the seventh feature, the torque distributor 90 can distribute the rotational torque generated by the rotation of the cylindrical portion 70.

Eighth Feature

According to an eighth feature, for example, as illustrated in FIGS. 9A and 9B, the joining section 60 and the receiving section 69 have the reservoir 91 or 92 between them for holding adhesive or glue.

Advantageous Effects of Eighth Feature

According to the eighth feature, the reservoir 91 or 92 can be filled or overfilled with adhesive or glue to prevent the adhesive or glue from leaking to a visible part, or bleeding, and improve the appearance of the cap 10.

Ninth Feature

According to a ninth feature, for example, as illustrated in FIG. 10, the joining section 60 includes the energy directors for ultrasonic welding (hereinafter, referred to as the EDs) 93 arranged in a radial, circular, or polygonal pattern with respect to the center of the joining section 60.

Advantageous Effects of Ninth Feature

According to the ninth feature, the appropriately arranged EDs 93 enable the joining section 60 and the receiving section 69 to be firmly bonded together.

Seventh Embodiment

A seventh embodiment of the present invention will now be described.

(Cap 10)

Figure 11:
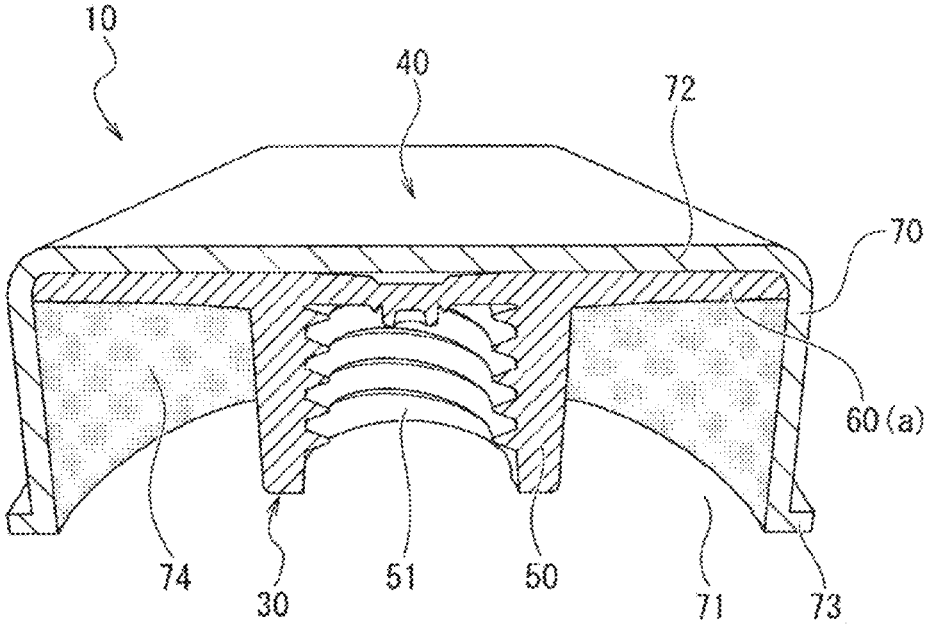
FIG. 11 is a cross-sectional view of a part of a cap according to a seventh embodiment of the present invention.
Figure 12:
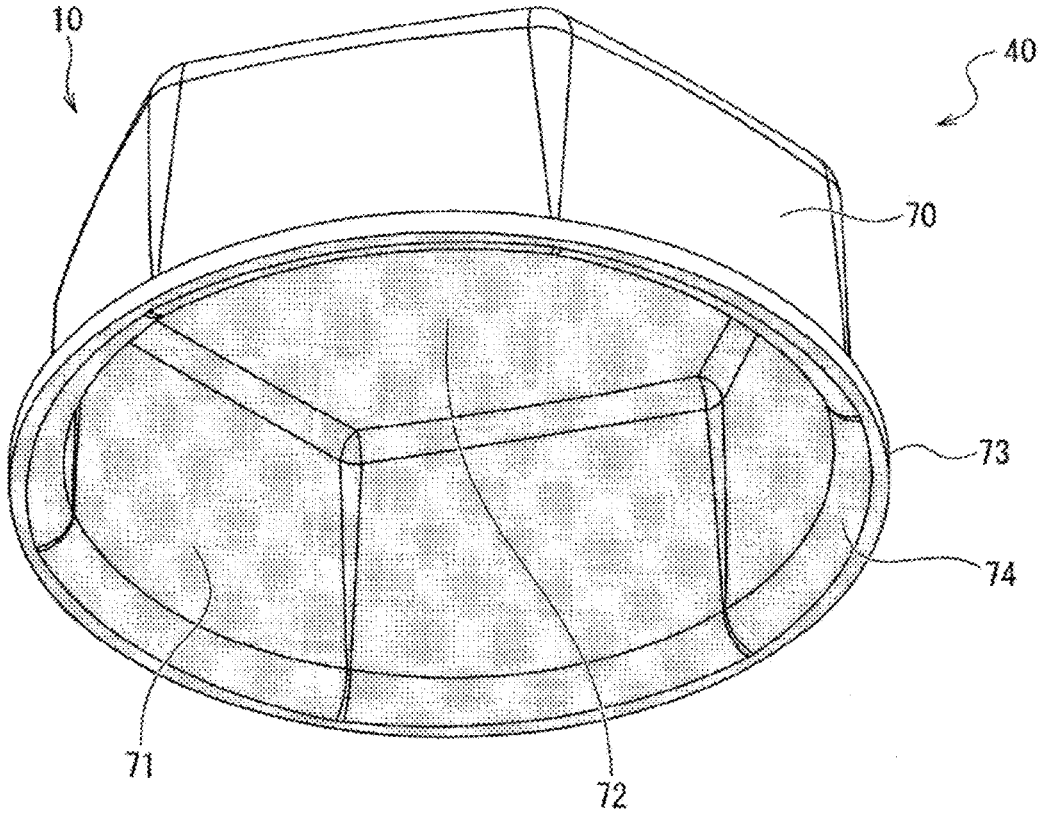
FIG. 12 is an exploded perspective view of the cap illustrated in FIG. 11.
Figure 12:
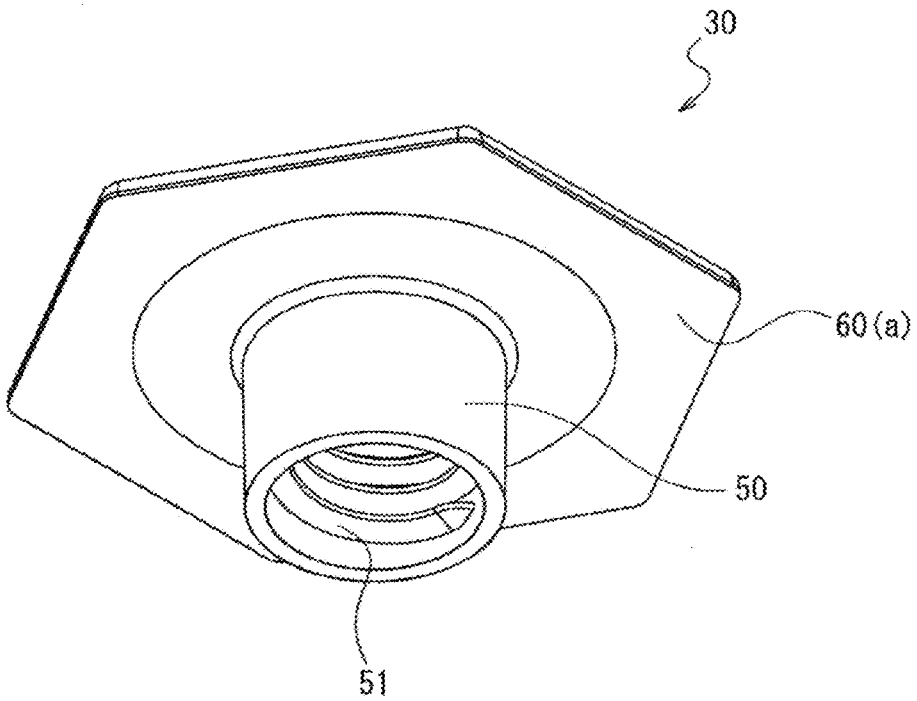

As illustrated in FIGS. 11 and 12, a cap 10 in the embodiments described below mainly includes a molded plastic product 30 and a molded paper product 40 with the molded plastic product 30 engaged inside through an opening 71.

(Each Part of Molded Paper Product 40)

As illustrated in FIGS. 11, 12, and 5, the molded paper product 40 in the embodiments described below includes a cylindrical portion 70. The cylindrical portion 70 will be described in detail later.

(Joining Section 60)

The joining section 60 of the molded plastic product 30 in the embodiments described below spreads from the top of the lid 50 and engages the inside of the cylindrical portion 70 through the opening 71. The joining section 60 has, across its center, right and left outer opposite end surfaces located within the interval between the opposite parts of the inner surface of the cylindrical portion 70. The interval between the right and left outer opposite end surfaces across the center of the joining section 60 is equal to or greater than the interval between the opposite parts of the inner surface of the cylindrical portion 70 across the entire perimeter. The joining section 60 thus fits in the interval between the opposite parts of the inner surface of the cylindrical portion 70. The joining section 60 is in full contact with the inner surface of the cylindrical portion 70 to serve as a fall prevention section (a) that prevents the molded plastic product 30 from falling through the opening 71 due to the frictional resistance between these sections.

The cylindrical portion 70 also has a mesh-like uneven section 74 on its inner surface and more reliably prevents the falling with the outside end surface of the joining section 60 caught in the section.

(Cylindrical Portion 70)

The cylindrical portion 70 in the embodiments described below is hollow inside, and with the molded plastic product 30 fitted inside, the molded paper product 40 and the molded plastic product 30 rotate together. The cylindrical portion 70 extends from the entire outer periphery in a manner that surrounds the molded plastic product 30. When the lid 50 closes the mouth 21, the distal end of the extension is in contact with the container 20 to conceal the mouth 21 of the container 20.

(Assembly of Cap 10)

The assembly of the cap 10 will now be described with reference to FIGS. 11 and 12.

When the molded plastic product 30 is inserted into the molded paper product 40 from the joining section 60 to fit the opening 71 in the cylindrical portion 70, the outer opposite end surfaces of the joining section 60 push the opposite parts of the inner surface of the cylindrical portion 70 to fit into the opening 71 in the cylindrical portion 70 while stretching the paper. The molded plastic product 30 is pushed into the molded paper product 40 until the top surface of the joining section 60 comes into contact with the bottom surface of the top portion 72.

When the joining section 60 is fitted in the cylindrical portion 70, the molded paper product 40 stretched during the fitting shrinks, and as a result, the inner surface of the cylindrical portion 70 and the outer surface of the joining section 60 come into close contact with each other to prevent the molded plastic product 30 from falling through the opening 71 in the cylindrical portion 70. Furthermore, since the inner surface of the cylindrical portion 70 is regular hexagonal and the outer surface of the joining section 60 is regular hexagonal, the inside and outside corners are matched to allow the molded paper product 40 and the molded plastic product 30 to rotate together.

Thus, even when the cap 10 is repeatedly placed on and removed from the container 20, the molded plastic product 30 and the molded paper product 40 do not easily separate from each other, enabling the cap 10 to function for a long time.

Eighth Embodiment

An eighth embodiment will now be described.

Figure 13:
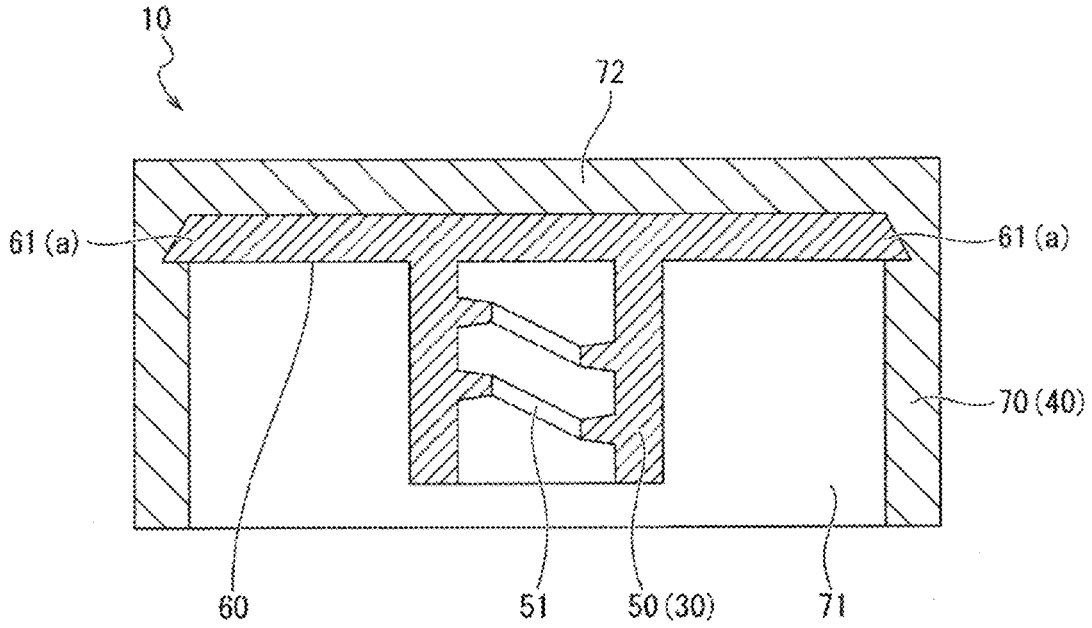
FIG. 13 is a cross-sectional view of a cap according to an eighth embodiment of the present invention.

The molded paper product 40 includes a cylindrical portion 70 having an opening 71 at one end, the molded plastic product 30 includes, as illustrated in FIG. 13, a lid 50 for opening and closing the mouth 21 of the container 20 to be fitted with the cap 10 and a joining section 60 for joining to the molded paper product 40, and the fall prevention section (a) is located on the outer surface of the joining section 60 facing the inner surface of the cylindrical portion 70 and has protrusions 61 extending toward the inner surface of the cylindrical portion 70.

The protrusions 61 are determined to be lower than the thickness of the cylindrical portion 70.

When the joining section 60 is fitted into the opening 71 in the cylindrical portion 70 from below, the protrusions 61 located at both ends of the joining section 60 fit in the opening 71 in the cylindrical portion 70 while pressing and stretching the paper. When the joining section 60 is pushed in to bring its top surface into contact with the bottom surface of the top portion 72 and then slightly lowered, the joining section 60 bites into the inner surface of the cylindrical portion 70, preventing the molded plastic product 30 from falling through the opening 71 in the cylindrical portion 70.

The protrusions 61 are wedge-shaped and widen gradually toward the opening 71. The end surfaces of the protrusions 61 are undercut.

The wedge shape of the protrusions 61 makes it hard to release the bite of the protrusions 61.

Ninth Embodiment

A ninth embodiment will now be described.

Figure 14:
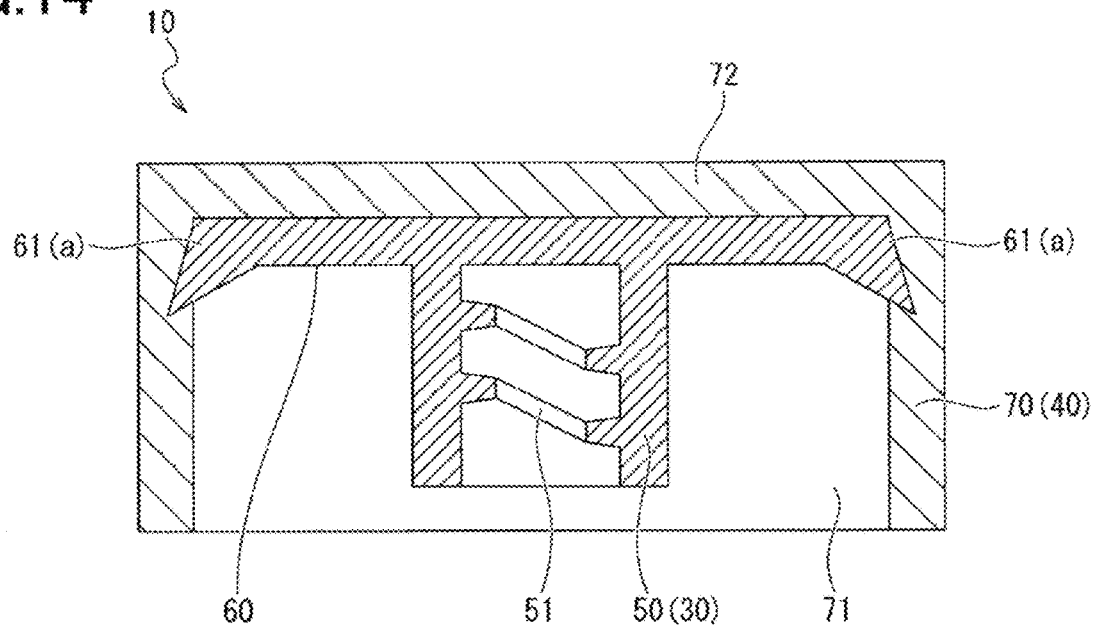
FIG. 14 is a cross-sectional view of a cap according to a ninth embodiment of the present invention.

As illustrated in FIG. 14, the protrusions 61 extend obliquely outward from the outer surface of the joining section 60 toward the opening 71.

The oblique extension of the protrusions 61 makes it harder to release the bite of the protrusions 61.

Tenth Embodiment

A tenth embodiment will now be described. The tenth embodiment includes three modifications 1 to 3.

Figure 15:
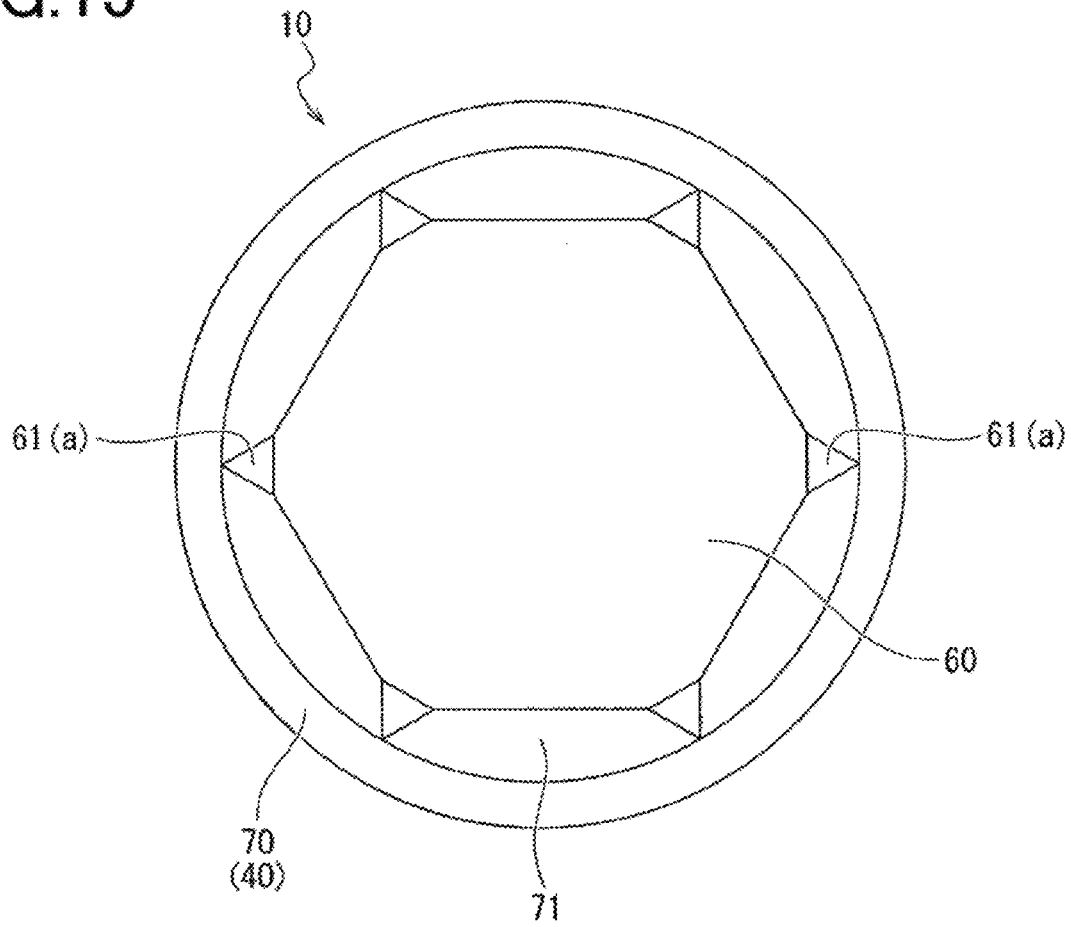
FIG. 15 is a plan view of a cap according to modification 1 of a tenth embodiment of the present invention.
Figure 16:
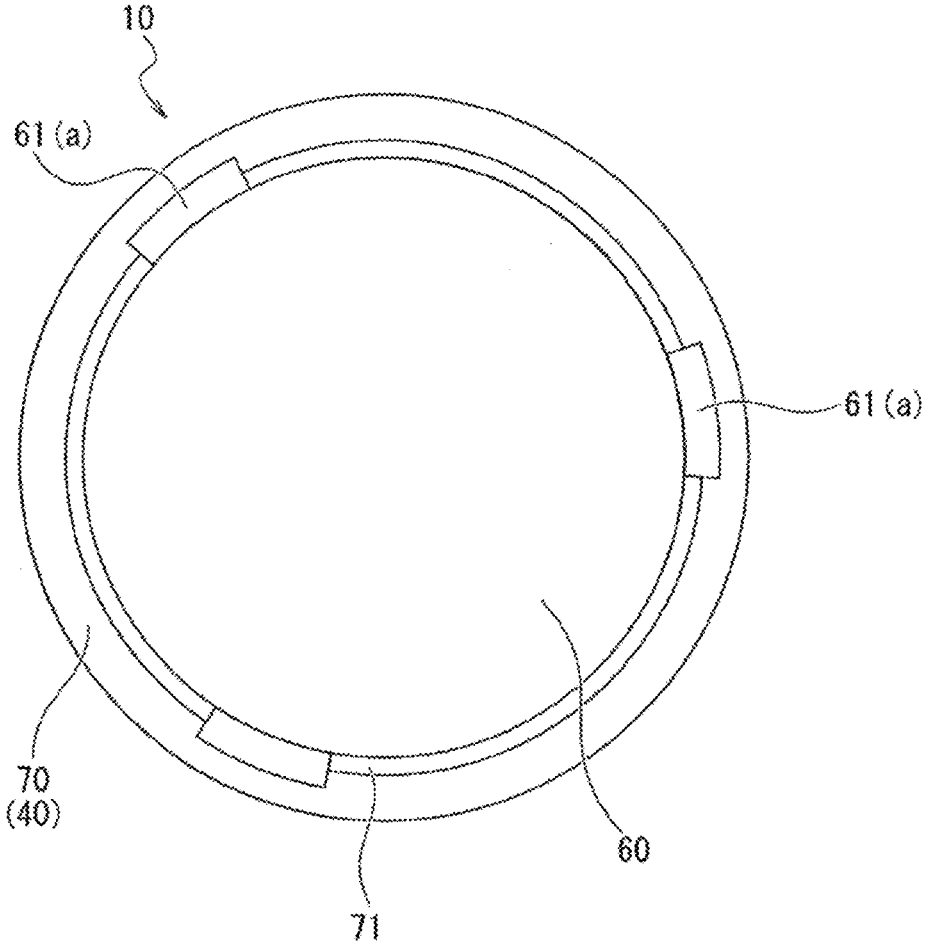
FIG. 16 is a plan view of a cap according to modification 2 of the tenth embodiment of the present invention.
Figure 17:
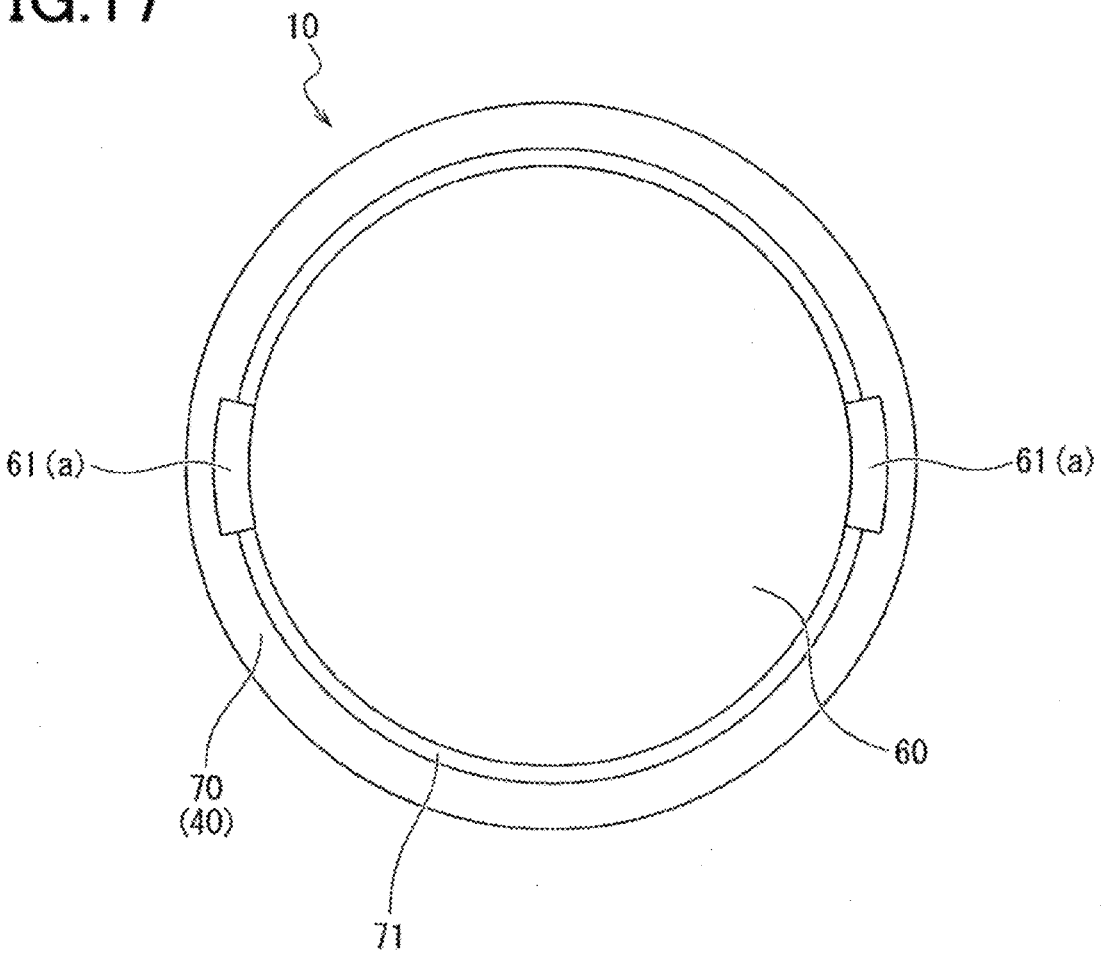
FIG. 17 is a plan view of a cap according to modification 3 of the tenth embodiment of the present invention.

As illustrated in FIGS. 15 to 17, the inner surface of the cylindrical portion 70 is circular in plan view, the joining section 60 is a polygonal or circular plate, and the protrusions 61 are formed at regular intervals around the circumference of the outer surface of the joining section 60. The protrusions 61 are evenly spaced circumferentially along the outer surface of the joining section 60. Thus, when the outer surface of the cylindrical portion 70 is held, the cylindrical portion 70 deforms slightly in the direction of contraction, causing, among the multiple protrusions 61, at least two protrusions 61 located along the diameter to bite evenly into the inner surface of the cylindrical portion 70. This prevents the molded plastic product 30 from coming off the cylindrical portion 70 and also allows the cylindrical portion 70 and the molded plastic product 30 to rotate together.

Modification 1 of Tenth Embodiment

Modification 1 of the tenth embodiment will now be described.

As illustrated in FIG. 15, the inner surface of the cylindrical portion 70 is circular in plan view, the joining section 60 is located on the circular inner surface, and the joining section 60 is a polygonal plate such as a regular hexagonal plate. The polygon has, at its corners, a total of six conical protrusions 61 toward the inner surface of the cylindrical portion 70, and the protrusions 61 are formed at regular intervals around the circumference of the outer surface. In other words, the protrusions 61 are spaced at 60 degrees circumferentially along the outer surface of the joining section 60. Thus, when the outer surface of the cylindrical portion 70 is held, the cylindrical portion 70 deforms slightly in the direction of contraction, causing, among the six protrusions 61, at least two protrusions 61 located along the diameter to bite into the inner surface of the cylindrical portion 70. This prevents the molded plastic product 30 from coming off the cylindrical portion 70 and also allows the cylindrical portion 70 and the molded plastic product 30 to rotate together.

Modification 2 of Tenth Embodiment

Modification 2 of the tenth embodiment will now be described.

As illustrated in FIG. 16, the inner surface of the cylindrical portion 70 is circular in plan view, the joining section 60 is located on the circular inner surface, the joining section 60 is a square or rectangular plate, and the joining section 60 has a total of three protrusions 61 on its outer surface. The protrusions 61 are formed at regular intervals, or at 120 degrees, around the circumference of the outer surface. The protrusions 61 are evenly spaced circumferentially along the outer surface of the joining section 60. Thus, when the outer surface of the cylindrical portion 70 is held, the cylindrical portion 70 deforms slightly in the direction of contraction, causing the three protrusions 61 to bite into the inner surface of the cylindrical portion 70. This prevents the molded plastic product 30 from detaching from the cylindrical portion 70 and also allows the cylindrical portion 70 and the molded plastic product 30 to rotate together.

Modification 3 of Tenth Embodiment

Modification 3 of the tenth embodiment will now be described.

As illustrated in FIG. 17, the inner surface of the cylindrical portion 70 is circular in plan view, the joining section 60 is located on the circular inner surface, the joining section 60 is a square or rectangular plate, and the joining section 60 has a total of two protrusions 61 on its outer surface. The protrusions 61 are formed at regular intervals, or at 180 degrees, around the circumference of the outer surface.

When the opposite areas of the outer surface of the cylindrical portion 70 that are 90° out of phase with and orthogonal to the facing direction of the two protrusions 61 are pressed closer together by hand, the cylindrical portion 70 deforms into an ellipse longer in the facing direction of the two protrusions 61, separating the two protrusions 61 from the inner surface of the cylindrical portion 70 and releasing the bite. The joining section 60 can thus be extracted from the cylindrical portion 70 through the opening 71, allowing the molded paper product 40 and the molded plastic product 30 to be disposed of separately.

11th Embodiment

An 11th embodiment will now be described.

Figure 18:
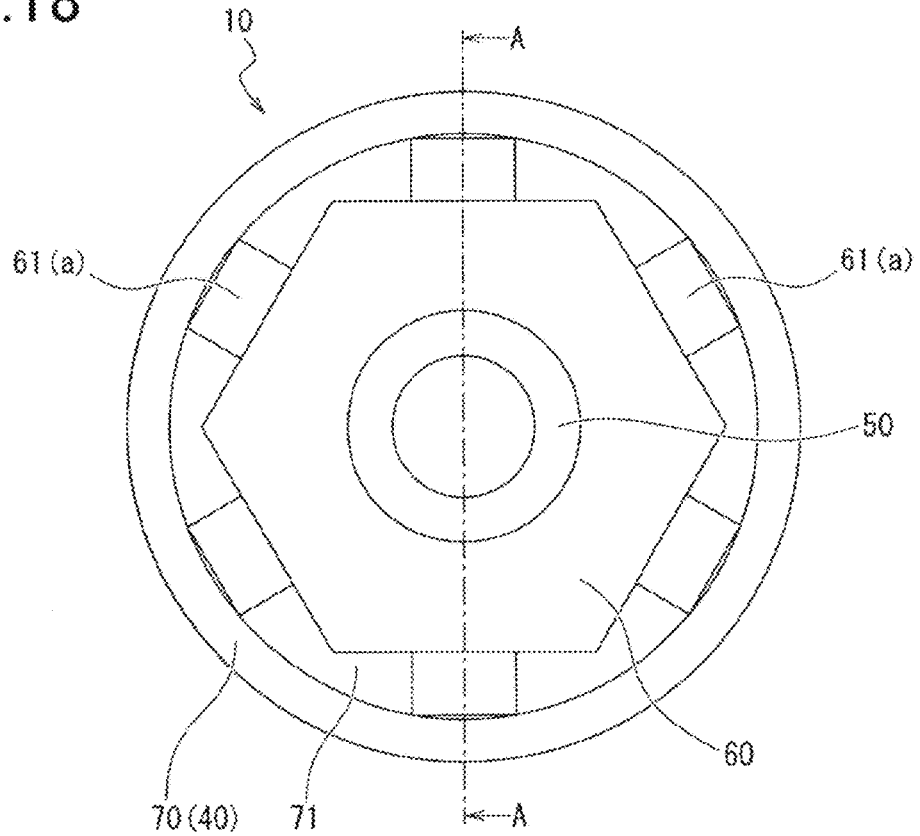
FIG. 18 is a plan view of a cap according to an 11th embodiment of the present invention.
Figure 19:
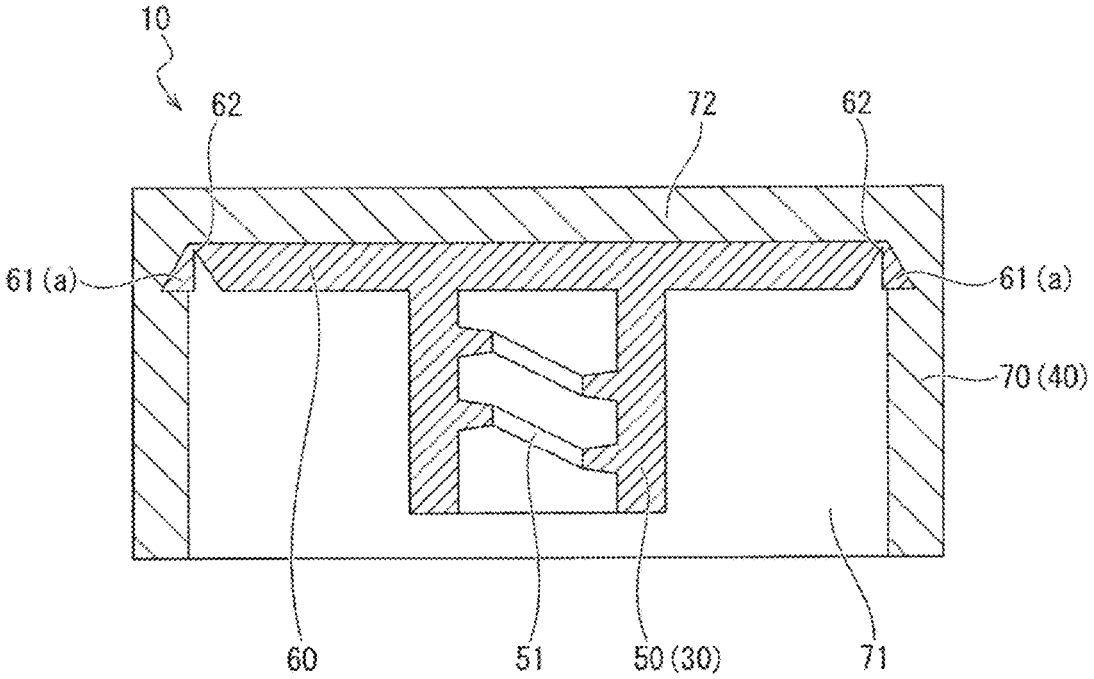
FIG. 19 is a cross-sectional view taken along line A-A in FIG. 18.
Figure 20:
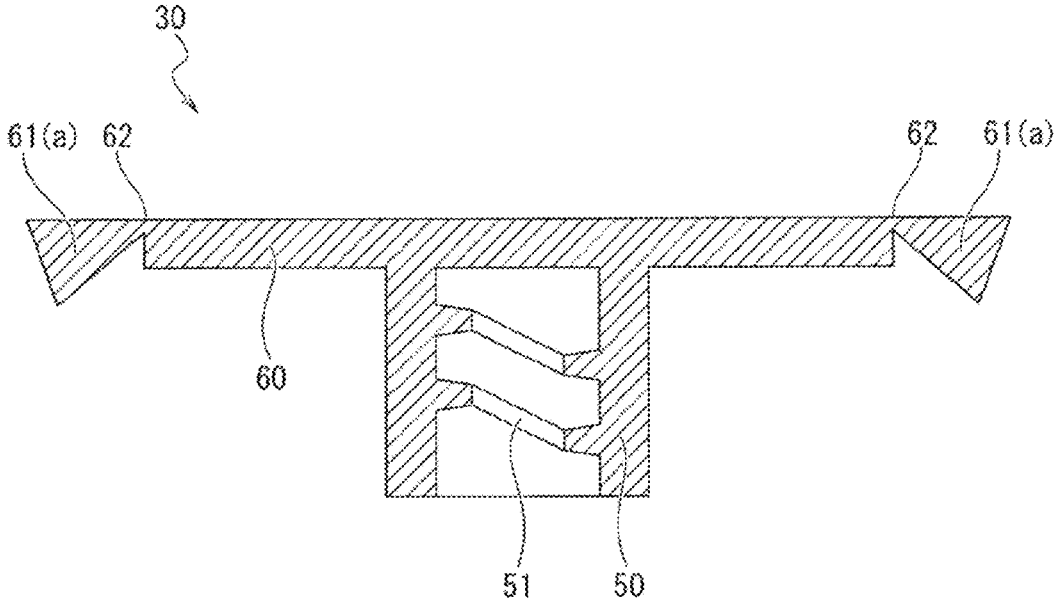
FIG. 20 is a longitudinal sectional view of a molded plastic product before fitting.
Figure 21:
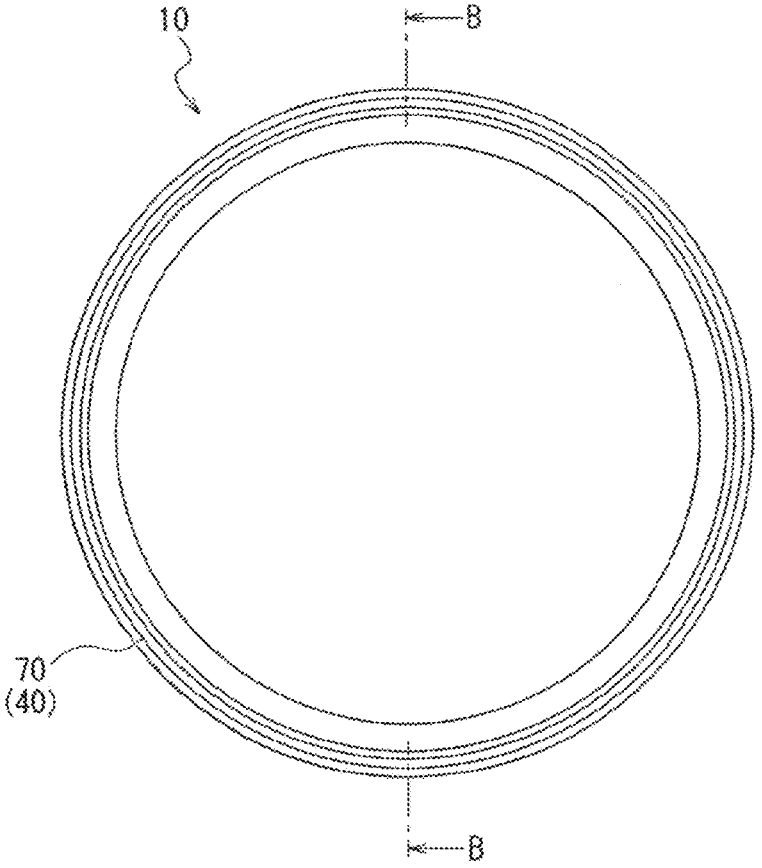
FIG. 21 is a plan view of a cap according to a 12th embodiment of the present invention.
Figure 22:
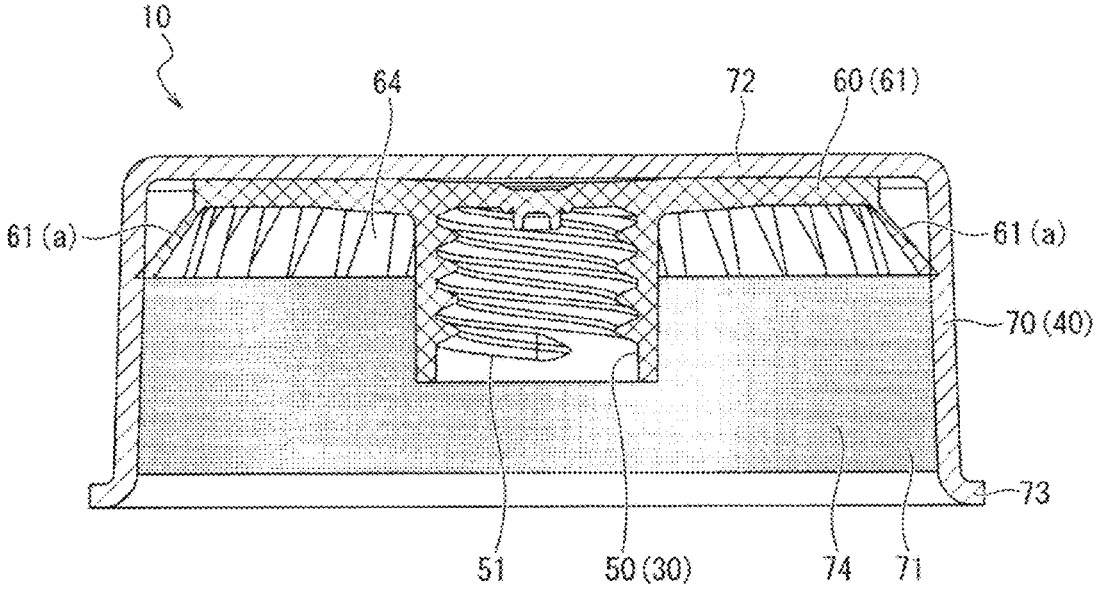
FIG. 22 is a cross-sectional view taken along line B-B in FIG. 21.
Figure 23:
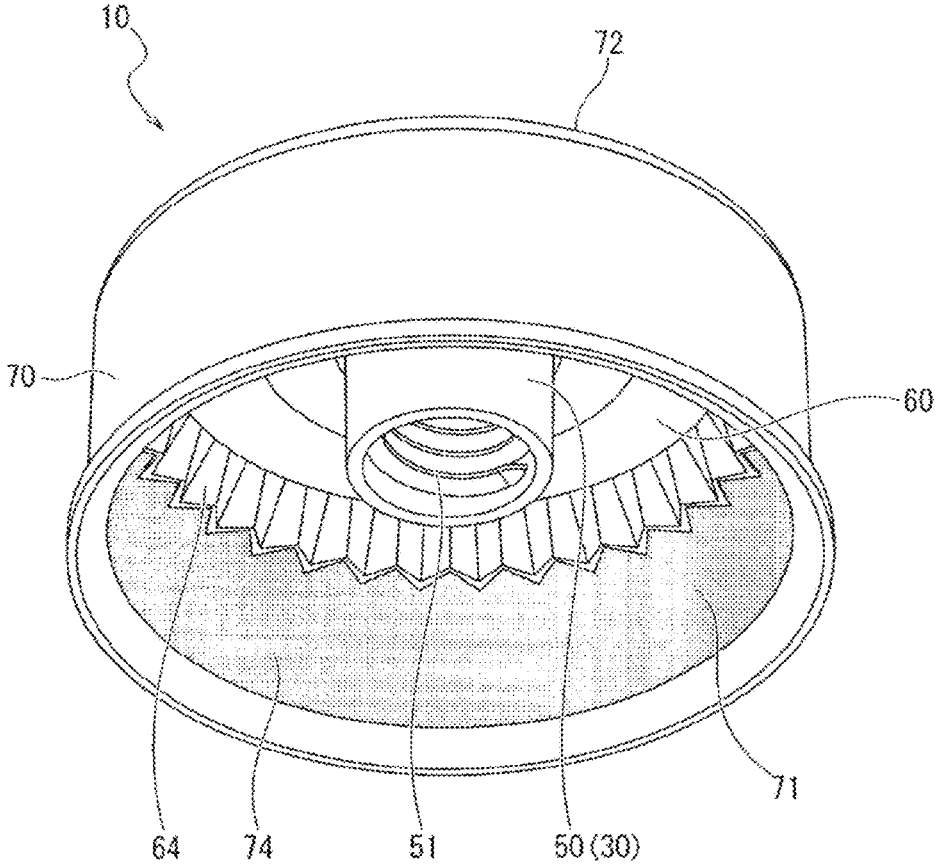
FIG. 23 is a perspective bottom view of the cap illustrated in FIG. 21.
Figure 24:
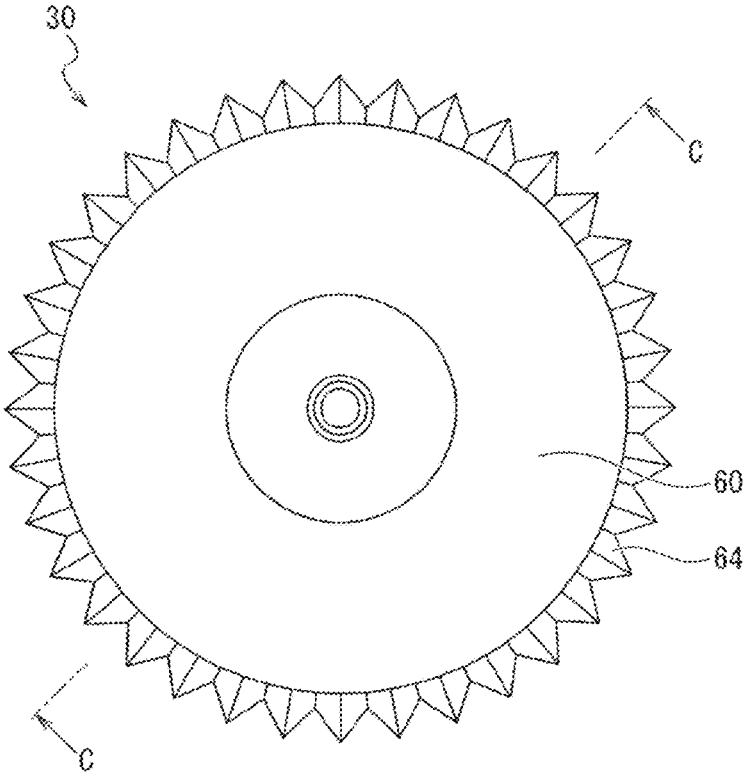
FIG. 24 is a bottom view of a molded plastic product illustrated in FIG. 21.
Figure 25:
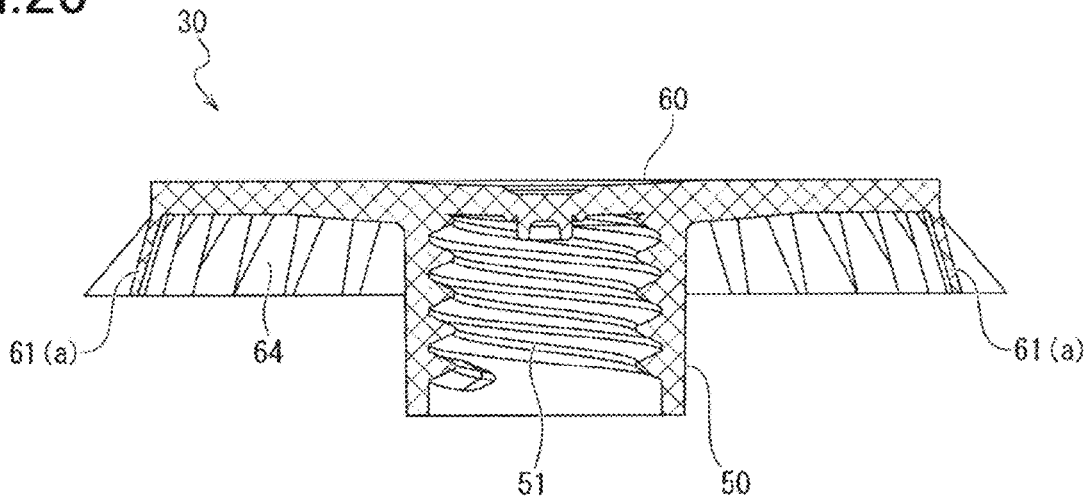
FIG. 25 is a cross-sectional view taken along line C-C in FIG. 24.
Figure 26:
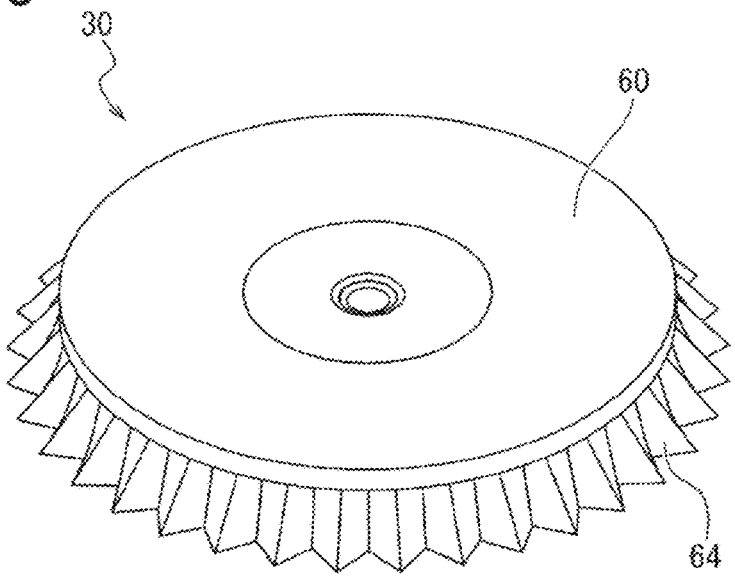
FIG. 26 is a perspective view of the molded plastic product illustrated in FIG. 24.

As illustrated in FIGS. 18 to 20, a thin hinge 62 is provided between each protrusion 61 and the joining section 60.

The inner surface of the cylindrical portion 70 is circular in plan view, and the joining section 60 is located on the inner periphery of the cylindrical portion 70 and is a plate with a polygonal outer shape such as a regular hexagon. The interval between opposite sides of the joining section 60 is shorter than the inner diameter of the cylindrical portion 70, and the outer surface on the sides of the joining section 60 is located away from the inner surface of the cylindrical portion 70. Each of the six sides has a protrusion 61, and as a result, the joining section 60 as a whole includes six protrusions 61 arranged at 60-degree intervals. Between each protrusion 61 and the joining section 60, the hinge 62 is formed by cutting the bottom surface of the joining section 60 into an upward triangle.

As illustrated in FIG. 20, before fitting in the cap 10, each protrusion 61 extends straight from the joining section 60 via the hinge 62. When inserted to fit the opening 71 in the cylindrical portion 70, as illustrated in FIG. 19, the joining section 60 travels through the opening 71 while the protrusion 61 is pushed by the end surface of the opening 71 and bent downward via the hinge 62. Furthermore, when the joining section 60 travels through the opening 71, the joining section 60 travels into the cylindrical portion 70 while the protrusions 61 push the inner surface of the cylindrical portion 70 and stretch the paper. The joining section 60 is pushed until its top surface comes into contact with the bottom surface of the top portion 72, and when the force of the push is released, the protrusions 61 bite into the inner surface of the cylindrical portion 70 to prevent the molded plastic product 30 from falling through the opening 71 in the cylindrical portion 70. The bites of the six protrusions 61 spaced at predetermined intervals in the inner surface of the cylindrical portion 70 allow the molded paper product 40 and the molded plastic product 30 to rotate together when the cap 10 is rotated.

12th Embodiment

A 12th embodiment will now be described.

As illustrated in FIGS. 21 to 26, 36 protrusions 61 are formed at 10-degree intervals around the circumference of the joining section 60 and include 36 connectors 64 for connecting adjacent protrusions 61 in the form of a skirt in a circumferential direction of the joining section 60.

Thus, the protrusions 61 are finely distributed into dots to increase the number of bites into the inner surface of the cylindrical portion 70 and improve the ability of the cap 10 to follow deformation, adjacent protrusions 61 are connected in the form of a skirt and pleated to improve the fitting of the cap 10 against deformation, and the protrusions are arranged evenly around the entire circumference to more reliably reduce the likelihood of the cap detaching.

13th Embodiment

A 13th embodiment will now be described.

Figure 27:
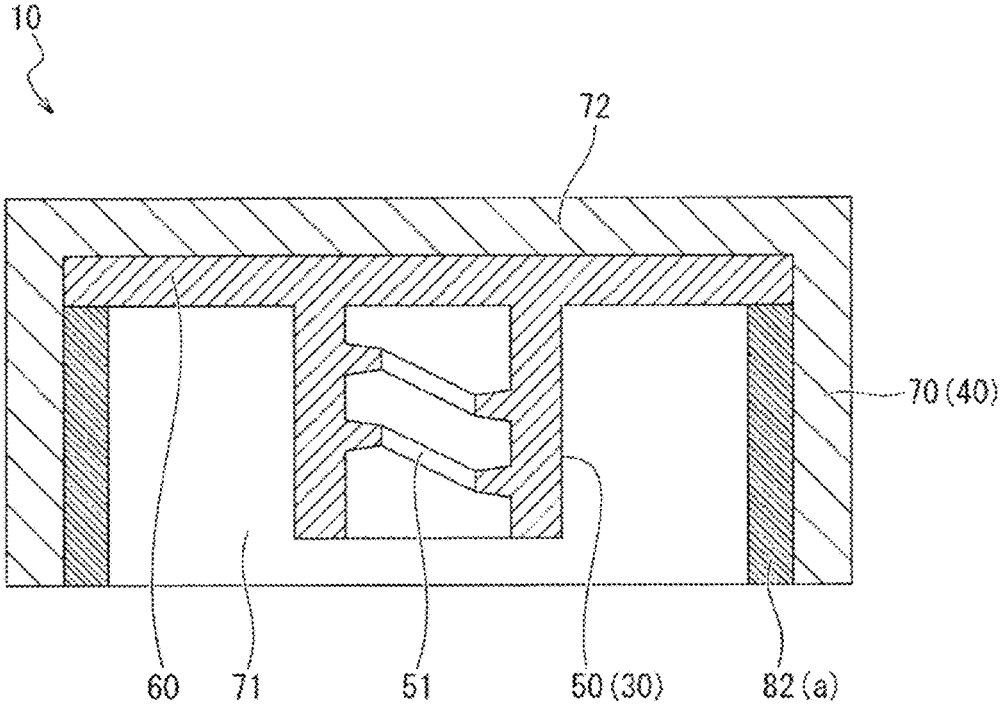
FIG. 27 is a cross-sectional view of a cap according to a 13th embodiment of the present invention.

As illustrated in FIG. 27, the molded paper product 40 includes a cylindrical portion 70 having an opening 71 at one end and a top portion 72 covering the other end of the cylindrical portion 70, and the molded plastic product 30 includes a lid 50 for opening and closing the mouth 21 and a joining section 60 for joining to the molded paper product 40. The cylindrical portion 70 has an open-top and open-bottom hollow cylindrical paper tube 82 fitted on its inner surface and serving as the fall prevention section (a). The paper tube 82 has an outer surface in contact with the inner surface of the cylindrical portion 70 to provide frictional resistance for preventing axial movement, with the peripheral edge of the joining section 60 positioned between one end surface of the paper tube and the top portion 72.

As a result, the paper tube 82 prevents the molded plastic product 30 from falling through the opening 71 in the cylindrical portion 70.

The paper tube 82 has a wall thickness equal to or greater than the wall thickness of the cylindrical portion 70. When the cylindrical portion 70 has a wall thickness of 1 mm, the wall thickness of the paper tube 82 is, for example, preferably 2 mm or more.

This can easily improve the rigidity of the cylindrical portion 70.

Modification of 13th Embodiment

A modification of the 13th embodiment will now be described.

In this modification, the outer surface of the paper tube 82 in the configuration in the 13th embodiment illustrated in FIG. 27 is further bonded to the inner surface of the cylindrical portion 70 with, for example, glue.

This enables the outer surface of the paper tube 82 to be securely fixed more firmly to the inner surface of the cylindrical portion 70.

14th Embodiment

A 14th embodiment will now be described.

Figure 28:
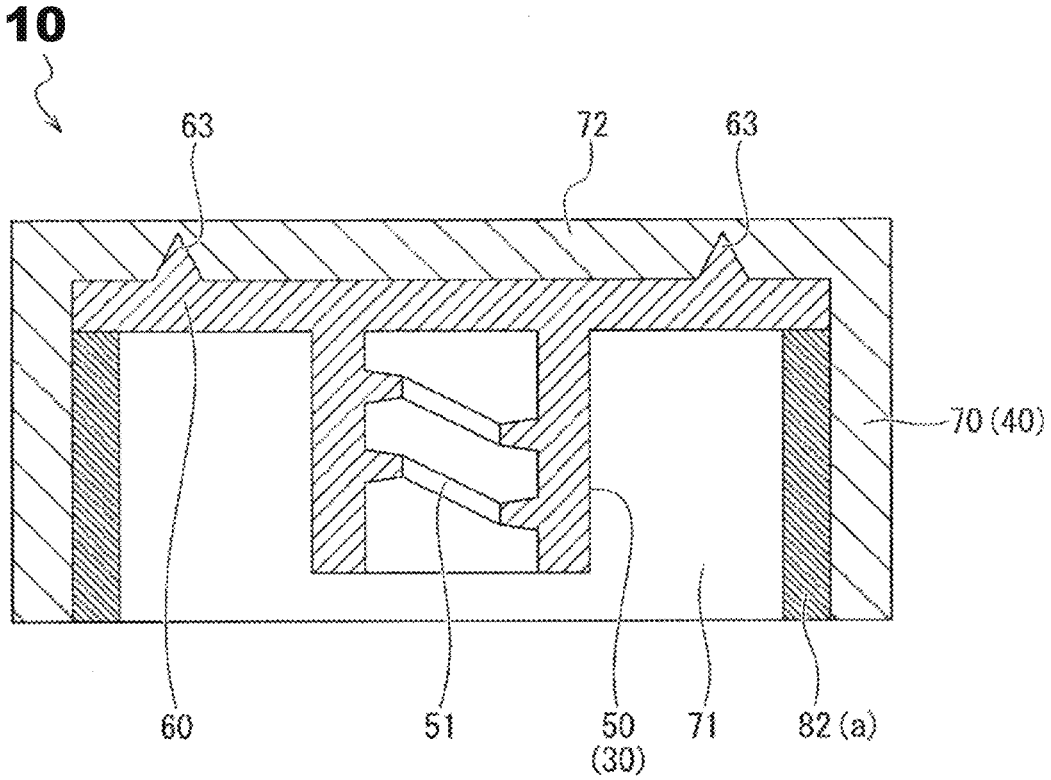
FIG. 28 is a cross-sectional view of a cap according to a 14th embodiment of the present invention.

As illustrated in FIG. 28, the configuration in the 14th embodiment includes the configuration in the 13th embodiment illustrated in FIG. 27, and additionally the joining section 60 includes, on the surface facing away from the lid 50, a spike 63 that bites into the top portion 72.

As a result, the spike 63 of the joining section 60 enables the paper tube 82 and the molded plastic product 30 to be rotated more reliably together.

15th Embodiment

A 15th embodiment will now be described.

Figure 29A:
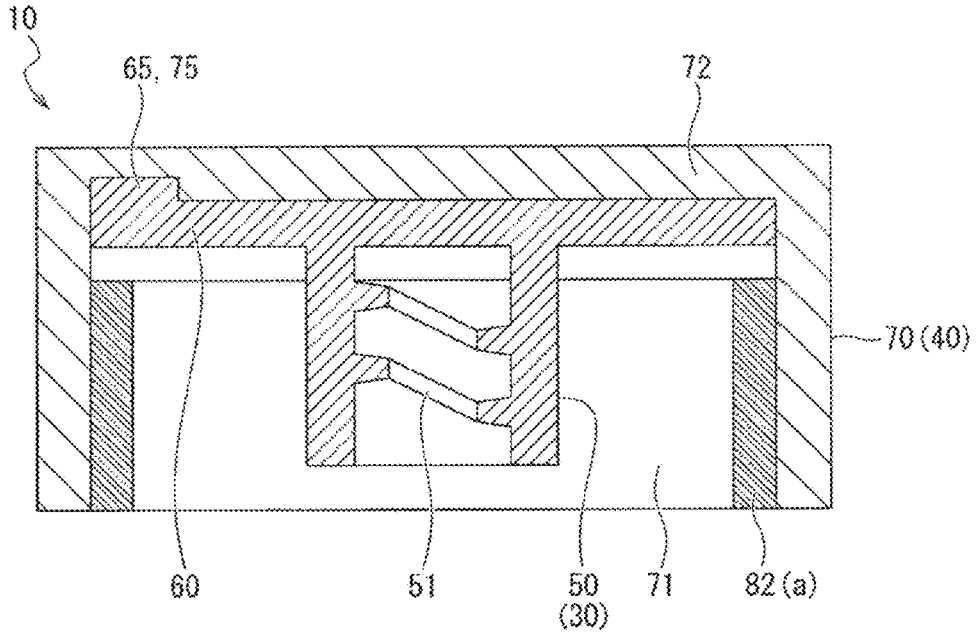
FIGS. 29A and 29B are diagrams according to a 15th embodiment of the present invention.
Figure 29B:
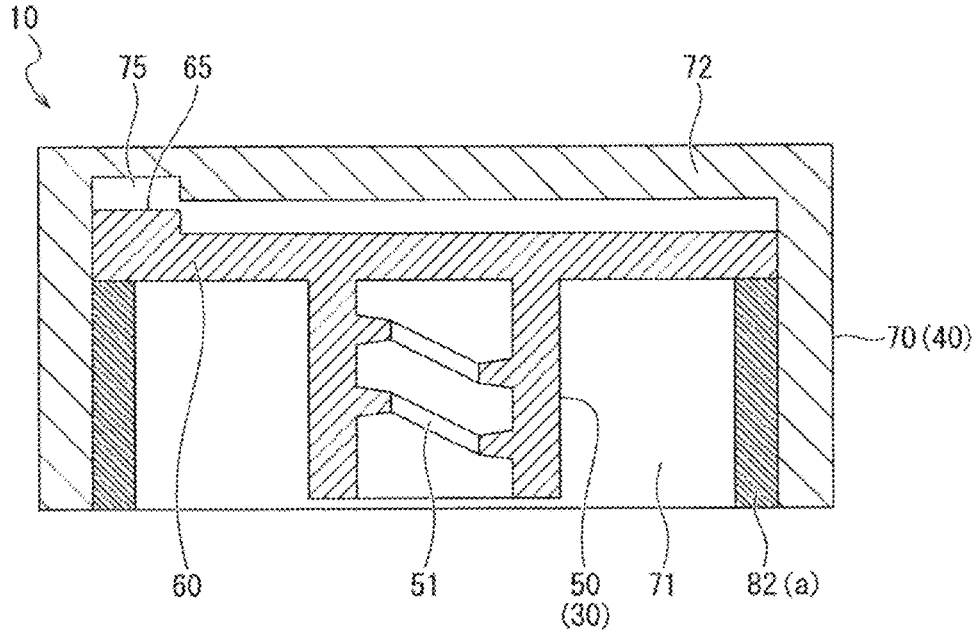

As illustrated in FIGS. 29A and 29B, the paper tube 82 in the 15th embodiment is fixed to the inner surface of the cylindrical portion 70 in a position that allows the joining section 60 to move in the axial direction of the cylindrical portion 70 between the top portion 72 and the end surface of the paper tube 82. The top portion 72 and the joining section 60 facing the top portion 72 respectively have a recess 75 and a projection 65 that fit together. The projection 65 has a height such that the projection 65 is completely out of the recess 75 in the position where the joining section 60 has moved most toward the paper tube 82.

(Fitting Between Recess 75 and Projection 65)

As illustrated in FIG. 29A, when the top portion 72 of the cylindrical portion 70 is pushed in toward the joining section 60, the recess 75 and the projection 65 fit together, and the paper tube 82 and the molded plastic product 30 are coupled to rotate together. This allows the container 20 to be opened only when the cylindrical portion 70 is pushed in.

(Separation Between Recess 75 and Projection 65)

In contrast, when the push on the top portion 72 of the cylindrical portion 70 is stopped, and the cylindrical portion 70 is intentionally moved upward, as illustrated in FIG. 29B, the recess 75 and the projection 65 are separated from each other, and the coupling between the paper tube 82 and the molded plastic product 30 is released. Even when the paper tube 82 is rotated, the molded plastic product 30 rotates freely. In this state, the container 20 cannot be opened.

As a result, as illustrated in FIG. 29B, with the recess 75 and the projection 65 disengaged, when the molded paper product 40 is rotated and displaced to a position where the recess 75 and the projection 65 do not overlap, the molded plastic product 30 cannot be rotated and removed from the container until the molded paper product 40 is rotated to a position where the recess 75 and the projection 65 fit together. This makes it possible to provide an accidental-operation prevention cap, such as a childproof cap, which cannot be accidentally opened or closed by, for example, a child.

Features and Advantageous Effects of Embodiments

The features and advantageous effects of the above embodiments are described below.

First Feature

According to a first feature, the cap 10 includes the molded plastic product 30 and the molded paper product 40 with the molded plastic product 30 engaged inside through the opening 71, for example, as illustrated in FIG. 11, and the molded plastic product 30 includes the fall prevention section (a) that prevents it from falling through the opening 71.

Advantageous Effects of First Feature

According to the first feature, the fall prevention section (a) can prevent the molded plastic product 30 from falling through the opening 71 in the molded paper product 40.

Second Feature

According to a second feature, the material of the molded paper product 40 accounts for more than 50% by mass of the total materials for the cap 10.

Advantageous Effects of Second Feature

According to the second feature, targets for reducing disposable plastic products can be better met by using the molded plastic product only to the extent necessary for the use of the cap and mainly and preferentially using the molded paper product.

Third Feature

According to a third feature, for example, as illustrated in FIG. 13, the molded paper product 40 includes the cylindrical portion 70 having the opening 71 at one end, the molded plastic product 30 includes the lid 50 for opening and closing the mouth 21 of the container 20 to be fitted with the cap 10 and the joining section 60 for joining to the molded paper product 40, and the fall prevention section (a) is located on the outer surface of the joining section 60 facing the inner surface of the cylindrical portion 70 and has the protrusions 61 extending toward the inner surface of the cylindrical portion 70.

Advantageous Effects of Third Feature

According to the third feature, for example, as illustrated in FIG. 13, the protrusions 61 of the joining section 60 may bite into the inner surface of the cylindrical portion 70 to prevent the molded plastic product 30 from detaching from the molded paper product 40 and falling through the opening 71.

Fourth Feature

According to a fourth feature, for example, as illustrated in FIG. 11, the cylindrical portion 70 has the mesh-like uneven section 74 on its inner surface.

Advantageous Effects of Fourth Feature

According to the fourth feature, the protrusions 61 of the joining section 60 can be caught in the mesh-like uneven section 74 on the cylindrical portion 70 to more reliably prevent detachment.

Fifth Feature

According to a fifth feature, for example, as illustrated in FIG. 13, the protrusions 61 are wedge-shaped and widen gradually toward the opening 71.

Advantageous Effects of Fifth Feature

According to the fifth feature, the wedge shape of the protrusions 61 can make it hard for the protrusions 61 embedded in the inner surface of the cylindrical portion 70 to become detached.

Sixth Feature

According to a sixth feature, for example, as illustrated in FIG. 14, the protrusions 61 extend obliquely outward from the outer surface of the joining section 60 toward the opening 71.

Advantageous Effects of Sixth Feature

According to the sixth feature, the oblique extension of the protrusions 61 can make it hard for the protrusions 61 embedded in the inner surface of the cylindrical portion 70 to become detached.

Seventh Feature

According to a seventh feature, for example, as illustrated in FIGS. 15 to 17, the cylindrical portion 70 has a polygonal or circular inner surface in plan view, the joining section 60 is a polygonal or circular plate, and the protrusions 61 are formed at regular intervals circumferentially around the outer surface of the joining section 60.

Advantageous Effects of Seventh Feature

According to the seventh feature, for example, as illustrated in FIGS. 15 to 17, the multiple protrusions 61 are formed at regular intervals circumferentially around the outer surface of the joining section 60 to evenly distribute the force of removing the protrusions 61, reducing the likelihood that the protrusions 61 will become detached.

Eighth Feature

According to an eighth feature, for example, as illustrated in FIGS. 18 to 26, the thin hinge 62 is provided between each protrusion 61 and the joining section 60.

Advantageous Effects of Eighth Feature

According to the eighth feature, the use of the thin hinge 62 allows the protrusions 61 to be pressed toward the inner surface of the cylindrical portion 70, thus improving the ability of the cap 10 to follow deformation.

Ninth Feature

According to a ninth feature, for example, as illustrated in FIGS. 20 to 26, the multiple protrusions 61 are formed at regular intervals around the circumference of the joining section 60 and include the connectors 64 for connecting adjacent protrusions 61 in the form of a skirt in a circumferential direction of the joining section 60.

Advantageous Effects of Ninth Feature

According to the ninth feature, the protrusions 61 may be connected in the form of a skirt by the connectors 64 to improve the ability of the cap 10 to follow deformation.

Tenth Feature

According to a tenth feature, for example, as illustrated in FIGS. 27 to 29, the molded paper product 40 includes the cylindrical portion 70 having the opening 71 at one end and the top portion 72 covering the other end of the cylindrical portion 70, and the molded plastic product 30 includes the lid 50 for opening and closing the mouth 21 and the joining section 60 for joining to the molded paper product 40. The cylindrical portion 70 has the open-top and open-bottom hollow cylindrical paper tube 82 fitted on its inner surface and serving as the fall prevention section (a). The outer surface of the paper tube 82 is in contact with the inner surface of the cylindrical portion 70 to provide frictional resistance for preventing axial movement, with the peripheral edge of the joining section 60 positioned between one end surface of the paper tube and the top portion 72.

Advantageous Effects of Tenth Feature

According to the tenth feature, the paper tube 82 can prevent the molded plastic product 30 from becoming detached.

11th Feature

According to an 11th feature, for example, as illustrated in FIG. 28, the joining section 60 includes, on the surface facing away from the lid 50, the spike 63 that bites into the top portion 72.

Advantageous Effects of 11th Feature

According to the 11th feature, the bite of the spike 63 of the joining section 60 in the top portion 72 allows the paper tube 82 and the molded plastic product 30 to reliably rotate together.

12th Feature

According to a 12th feature, for example, as illustrated in FIGS. 27 to 29, the joining section 60 is sandwiched between the top portion 72 and the end surface of the paper tube 82.

Advantageous Effects of 12th Feature

According to the 12th feature, with the joining section 60 sandwiched between the top portion 72 and the end surface of the paper tube 82, the use of the paper tube 82 can prevent the molded plastic product 30 from becoming detached as well as regulate the movement of the joining section 60 within a certain range.

13th Feature

According to a 13th feature, for example, as illustrated in FIGS. 29A and 29B, the paper tube 82 is fixed to the inner surface of the cylindrical portion 70 in a position that allows the joining section 60 to move in the axial direction of the cylindrical portion 70 between the top portion 72 and the end surface of the paper tube 82. The top portion 72 and the joining section 60 facing the top portion 72 respectively have the recess 75 and the projection 65 that fit together. The projection 65 has a height such that the projection 65 is completely out of the recess 75 in the position where the joining section 60 has moved most toward the paper tube 82.

Advantageous Effects of 13th Feature

According to the 13th feature, the use of the paper tube 82 can easily achieve an accidental-operation prevention cap, such as a childproof cap, which cannot be accidentally opened or closed by, for example, a child.

14th Feature

According to a 14th feature, for example, as illustrated in FIGS. 27 to 29, the cap 10 fitted over the mouth 21 of the container 20 to be fitted with the cap 10 includes the molded plastic product 30 and the molded paper product 40 formed mainly of paper and having the molded plastic product 30 fitted inside through the opening 71 in a manner rotatable together with the molded plastic product 30. The molded paper product 40 includes the cylindrical portion 70 having the opening 71 at one end, the top portion 72 covering the other end of the cylindrical portion 70, and the cylindrical paper tube 82 located on the inner surface of the cylindrical portion 70 and having an outer diameter equal to or smaller than the inner diameter of the cylindrical portion 70, with the outside of the paper tube overlapping the inside of the cylindrical portion 70. The paper tube 82 has a wall thickness equal to or greater than the wall thickness of the cylindrical portion 70.

Advantageous Effects of 14th Feature

According to the 14th feature, the use of the paper tube 82 can easily improve the rigidity of the cylindrical portion 70.

16th Embodiment

A 16th embodiment of the present invention will now be described.

Figure 30:
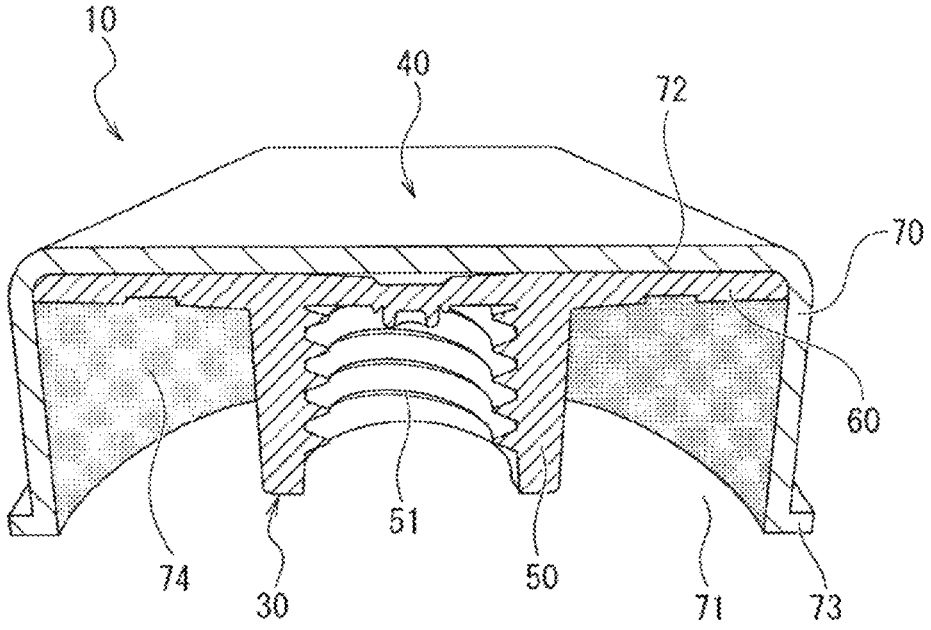
FIG. 30 is a cross-sectional perspective view of a part of a cap according to a 16th embodiment of the present invention.

FIG. 30 is a cross-sectional perspective view of a part of a cap 10 according to the 16th embodiment. As illustrated in FIG. 30, the cap 10 in this embodiment includes a molded paper product 40 and a molded plastic product 30. The molded plastic product 30 is a functional member including a tubular, for example, cylindrical lid 50 with a threaded portion 51 formed in its inner surface and screwed onto the external thread on the mouth 21 to cover the opening of the mouth 21. As described later, the molded plastic product 30 is fitted inside the molded paper product 40, and they are bonded and rotated together. The molded plastic product 30 includes a joining section 60 extending radially outwardly from the cylindrical lid 50 to join to the top portion 72 of the molded paper product 40. In the molded paper product 40 in this embodiment, the inside density is made smaller than the outside density in a manner described later. For a mouth 21 with an internal thread, the molded plastic product 30 is provided with a male thread instead of the threaded portion 51.

Figure 31A:
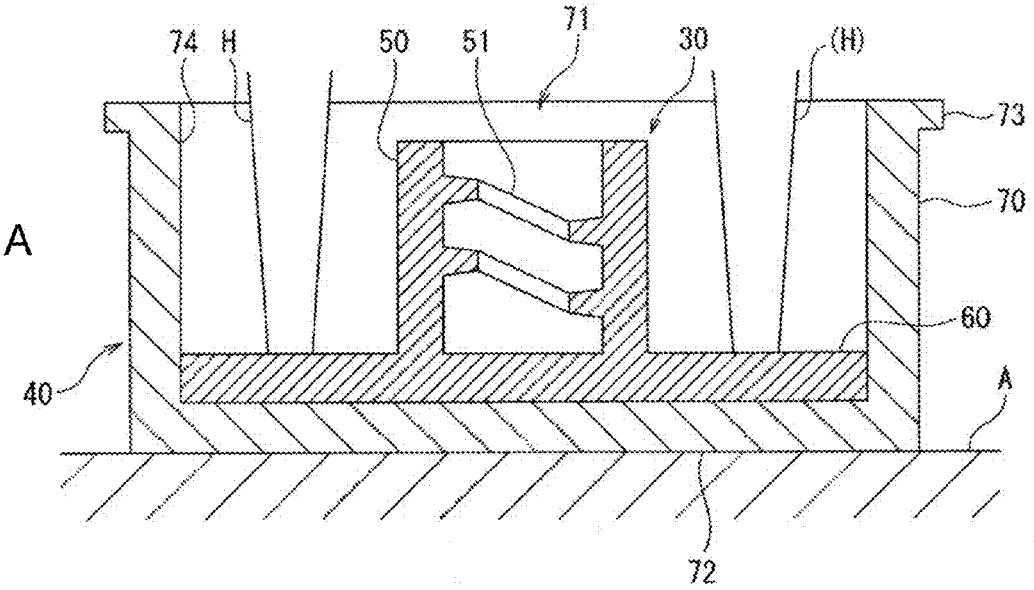
FIGS. 31A and 31B illustrate a bonding process for the cap in FIG. 30 and the resultant form of the cap.
Figure 31B:
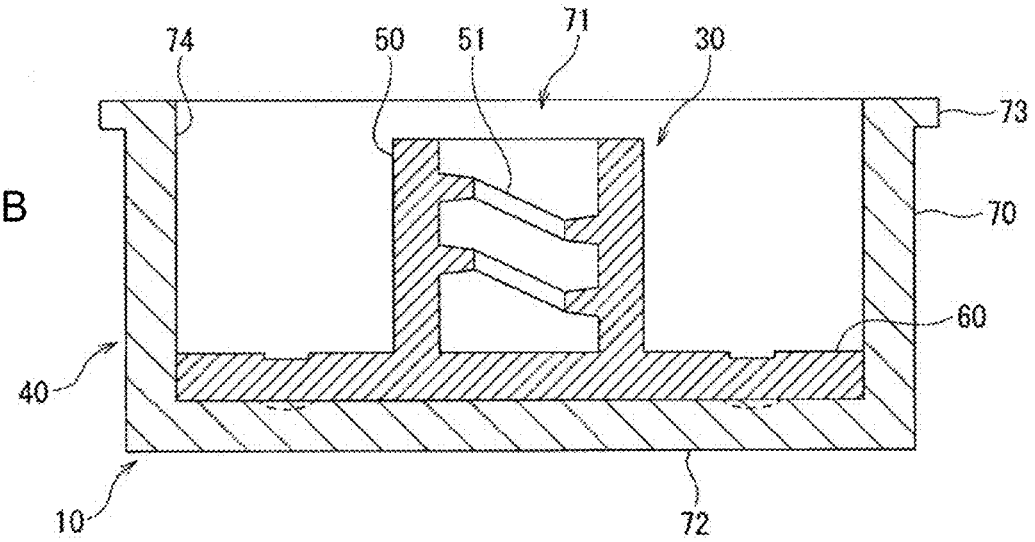

In this embodiment, the molded plastic product 30 and the molded paper product 40 are bonded together by ultrasonic welding. As is well known, ultrasonic welding is achieved by preparing workpieces to be welded together, placing the workpieces on top of each other on a support (anvil) A, and pressurizing the workpieces with a horn H that is in contact with the side of the workpieces opposite to the support A while applying ultrasonic vibration to the workpieces from the distal end of the horn H. When the workpieces are resin (plastic), the resin melts at the site of the pressure contact and solidifies to bond the workpieces together (somewhat different from the principle of ultrasonic welding for metal). FIG. 31A illustrates the process of ultrasonic welding between the molded paper product 40 and the molded plastic product 30 in this embodiment, and FIG. 31B is a cross-sectional view of the resultant cap 10. That is, in FIG. 31B, the molded paper product 40 and the molded plastic product 30 are bonded together by ultrasonic welding. FIGS. 31A and 31B schematically illustrates the cap 10. In this embodiment, the molded paper product 40 is placed on the support A with the opening 71 facing up, and the molded plastic product 30 is fitted inside with the joining section 60 in contact with the top portion 72. The horn H used has a cylindrical shape surrounding the lid 50 of the molded plastic product 30 to pressurize the joining section 60 and has a wall gradually narrowing toward the distal end in contact with the joining section 60. In this embodiment, the surface of the joining section 60 of the molded plastic product 30 in contact with the top portion 72 of the molded paper product 40 is smooth (flat).

In this embodiment, the flat part of the joining section 60 of the molded plastic product 30 melts partially at the site of contact with the horn H, and the melt infiltrates into (enters) fibers in the molded paper product 40 and then solidifies to weld (bond) the molded plastic product 30 and the molded paper product 40 together. The areas indicated by dashed lines in FIG. 31B schematically illustrate the areas of fibers infiltrated with the molten plastic. As described above, since the inside density of the molded paper product 40 in this embodiment is smaller than the outside density, the molten resin easily infiltrates into the inside area of the molded paper product 40 (more specifically, the top portion 72), thus increasing the bond strength between the molded plastic product 30 and the molded paper product 40. In this embodiment, as described above, since the mesh-like uneven section 74 is formed on the inner surface of the molded paper product 40, or in this case, on the inner surface of the top portion 72, the molten resin infiltrates (intrudes) into the uneven section 74 to increase the bond strength between the molded plastic product 30 and the molded paper product 40. In this embodiment, as described above, since the molded plastic product 30 is fitted in the molded paper product 40 in the shape of a polygon (hexagon) to regulate the relative rotation between them, the bonding between the molded plastic product 30 and the molded paper product 40 by ultrasonic welding is sufficient as long as the bonding provides the strength to resist the force in the direction of pulling these products, or the joining section 60 and the top portion 72, away from each other.

17th Embodiment

A 17th embodiment will now be described.

Figure 32A:
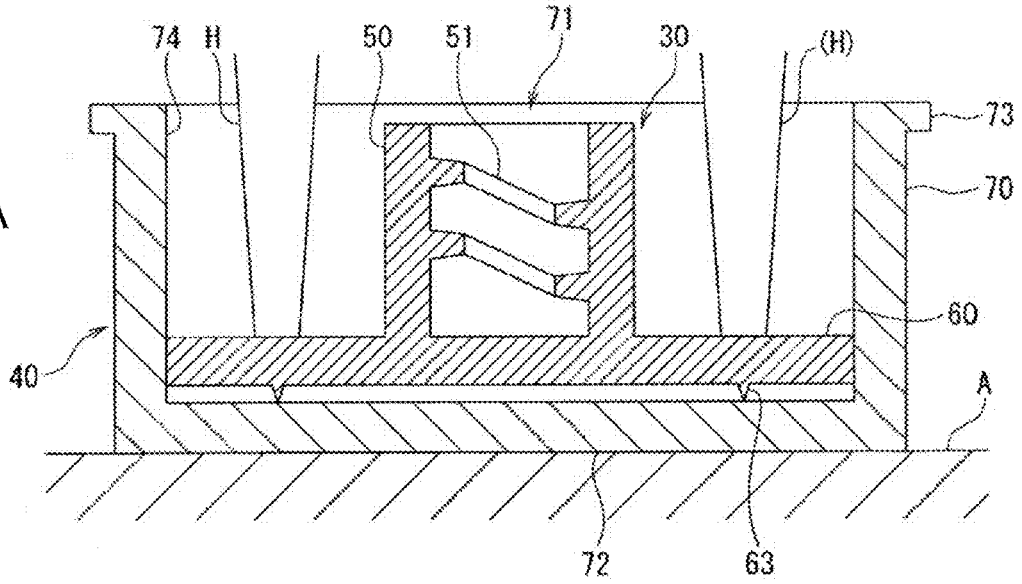
FIGS. 32A and 32B illustrate a bonding process for a cap according to a 17th embodiment of the present invention and the resultant form of the cap.
Figure 32B:
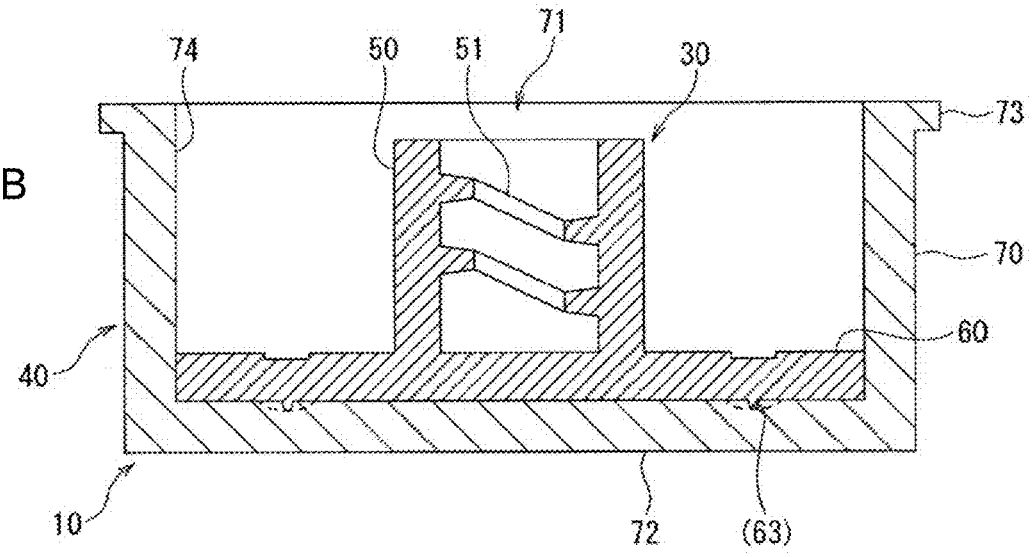

FIGS. 32A and 32B illustrates a cap 10 according to the 17th embodiment, and FIG. 32A illustrates the process of ultrasonic welding between the molded paper product 40 and the molded plastic product 30 in this embodiment, whereas FIG. 32B is a cross-sectional view of the resultant cap 10. The molded paper product 40 and the molded plastic product 30 included in the cap 10 have substantially the same main configuration as in the 16th embodiment. In this embodiment, the molded plastic product 30 has projections referred to as spikes (also referred to as energy directors) 63 on the surface facing the molded paper product 40, or specifically, the surface of the joining section 60 facing the top portion 72. The spikes 63 are conical or pyramidal with a relatively sharp tip. With the spikes 63 provided on the contact surface between workpieces, typically only the resin of the spikes 63 melts mainly during ultrasonic welding and then solidifies to weld (bond) the workpieces together. For example, the spikes 63 for ultrasonic welding between workpieces of resin enable the melting time to be shortened by concentrating ultrasonic vibration at the distal ends of the spikes 63 or the bonding strength to be balanced over the entire bonding surface by appropriately arranging the spikes 63. In this embodiment, in which the molded paper product 40 and the molded plastic product 30 are bonded together by ultrasonic welding, melting and solidification occur with the spikes 63 embedded in the molded paper product 40 as illustrated in FIG. 32B.

As described above, for the cap 10 in the embodiment in which the cylindrical portion 70 of the molded paper product 40 and the joining section 60 of the molded plastic product 30 are fitted in the shape of a polygon, there is no need to further regulate relative rotation between them. However, if they are relatively rotatable, the spikes 63 may serve as a regulator for regulating the relative rotation. The spikes 63 are arranged with such advantageous effects taken into account. For example, the spikes 63 may be arranged in concentric circles or a grid of dots. Spikes 63 arranged in concentric circles enable the ultrasonic vibration applied by the cylindrical horn H to be effectively distributed to each of the spikes 63. Spikes 63 arranged in concentric circles enable effective rotational regulation against rotational force (torque) for a circle with a short radius and also enable effective rotational regulation against rotational displacement for a circle with a long radius. The spikes 63 may not have the same size. For example, in order to regulate relative rotation and separation, large spikes 63 that penetrate deeply may physically regulate relative rotation, whereas the resin of small spikes 63 may infiltrate near the bonding surface of the molded paper product 40 to effectively prevent separation.

18th Embodiment

An 18th embodiment will now be described.

Figure 33A:
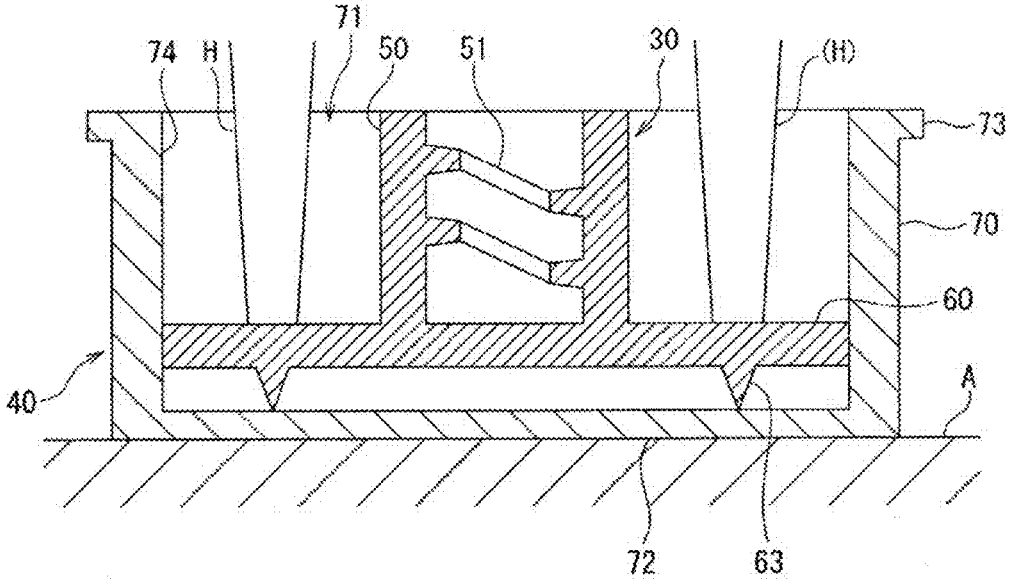
FIGS. 33A and 33B illustrate a bonding process for a cap according to an 18th embodiment of the present invention and the resultant form of the cap.
Figure 33B:
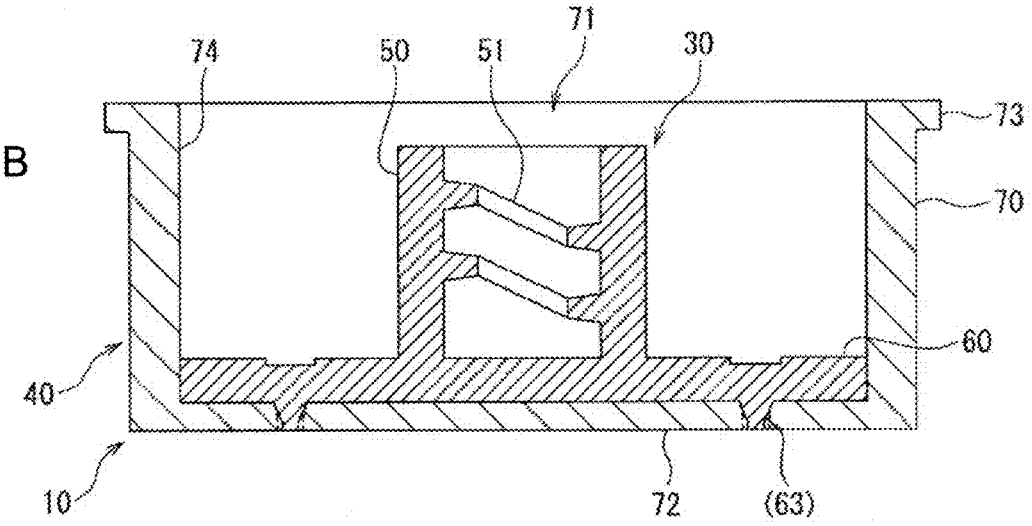

FIGS. 33A and 33B illustrate a cap 10 according to the 18th embodiment, and FIG. 33A illustrates the process of ultrasonic welding between the molded paper product 40 and the molded plastic product 30 in this embodiment, whereas FIG. 33B is a cross-sectional view of the resultant cap 10. The molded paper product 40 and the molded plastic product 30 included in the cap 10 have substantially the same main configuration as in the 16th embodiment. Also in this embodiment, the molded plastic product 30 has spikes 63 on the surface facing the molded paper product 40, or specifically, the surface of the joining section 60 facing the top portion 72. The spikes 63 are similar in shape to those in the 17th embodiment. In this embodiment, the spikes 63 are larger than the spikes 63 in the 17th embodiment, and the top portion 72 of the molded paper product 40 is thinner. As a result, the distal ends of the spikes 63 penetrate the top portion 72 of the molded paper product 40, and the resin of the part that has penetrated melts due to the heat generated from the friction with the support A caused by ultrasonic vibration and then solidifies to weld (bond) the molded plastic product 30 and the molded paper product 40 together. Some of the molten resin has solidified in the fibers in the top portion 72 of the molded paper product 40. The resultant molten and solidified spikes 63 serve as eyelets through the top portion 72 to increase the bond strength between the molded paper product 40 and the molded plastic product 30.

The arrangement of the spikes 63 is the same as in the 17th embodiment. For the spikes 63 that penetrate the molded paper product 40, through-holes or recesses may be preformed at the sites to be penetrated.

19th Embodiment

A 19th embodiment will now be described.

Figure 34A:
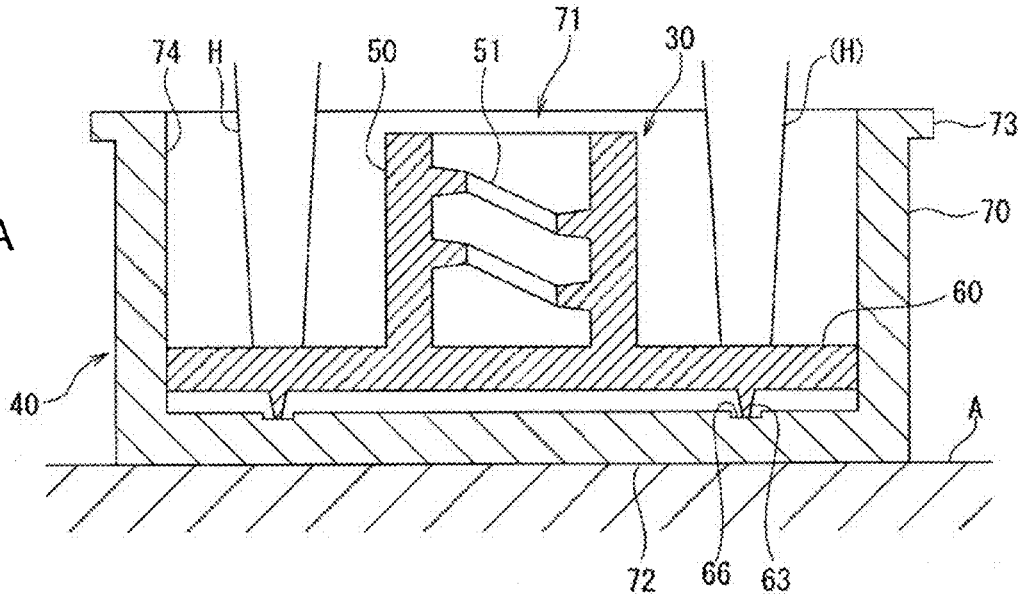
FIGS. 34A and 34B illustrates a bonding process for a cap according to a 19th embodiment of the present invention and the resultant form of the cap.
Figure 34B:
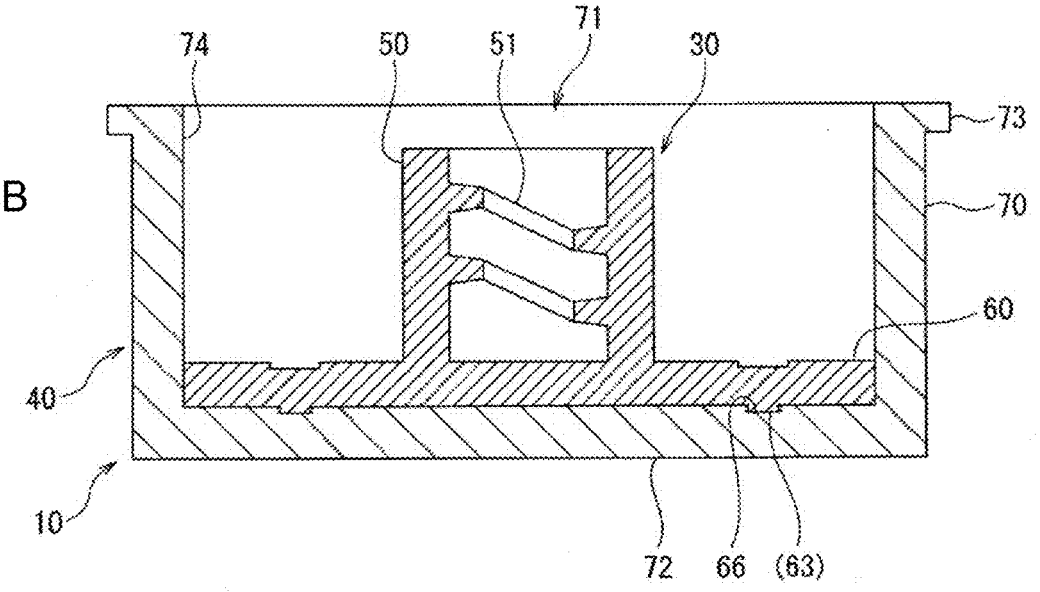

FIGS. 34A and 34B illustrate a cap 10 according to the 19th embodiment, and FIG. 34A illustrates the process of ultrasonic welding between the molded paper product 40 and the molded plastic product 30 in this embodiment, whereas FIG. 34B is a cross-sectional view of the resultant cap 10. The molded paper product 40 and the molded plastic product 30 included in the cap 10 have substantially the same main configuration as in the 16th embodiment. Also in this embodiment, the molded plastic product 30 has spikes 63 on the surface facing the molded paper product 40, or specifically, the surface of the joining section 60 facing the top portion 72. However, each spike 63 in this embodiment is a frustum with a flattened top. In this embodiment, the top portion 72 of the molded paper product 40 has a recess 66 preformed at a site that receives each spike 63. The recess 66 is formed by compressing the top portion 72 of the molded paper product 40 from inside in the thickness direction. As a result, the bottom of the recess 66 has a higher density because the fibers are compressed, whereas the fibers in the side surface are torn or broken. The recess 66 may be, for example, a continuous groove around the lid 50. When ultrasonic welding is performed with the spikes 63 fitted in the recess 66, the resin of the spikes 63 melts to fill the recess 66 and infiltrate into fibers in the molded paper product 40 mainly from the side surface of the recess 66, and the melt does not infiltrate much from the high-density bottom surface of the recess 66. That is, the resin solidified in the fibers of the molded paper product 40 has infiltrated from the side surface of the recess 66 and spread further outward from the recess 66. The spread resin can function like a flange of resin in the molded paper product 40 and increase the strength to resist force in a direction separating these products from each other. In this manner, since each spike 63 in this example does not need to pierce the molded paper product 40, the spike 63 has a flattened top.

The resin used for the molded plastic product 30 is determined based on physical properties such as rigidity, melting point, and melt fluidity. In particular, for the molded plastic product 30 having the spikes 63, when the resin has a low rigidity, the spikes 63 cannot easily pierce the molded paper product 40, but may melt on the bonding surface of the molded paper product 40 and infiltrate less into the fibers of the molded paper product 40. The amount of molten resin that infiltrates into the fibers of the molded paper product 40 depends also on the density of the molded paper product 40, so that the resin to be used cannot be determined based only on the rigidity of resin. However, when the resin is to be melted with the spikes 63 embedded in the molded paper product 40, a resin that ensures the rigidity of the spikes 63 is selected. The spikes 63 in the 18th embodiment penetrate the molded paper product 40 and melt by friction with the support A. However, when the fibers of the molded paper product 40 are to be sufficiently infiltrated with molten resin, the spikes 63 should not penetrate the molded paper product 40. In some cases, the rigidity of the resin may be adjusted so that the spikes 63 do not penetrate the molded paper product 40. Resins with lower melting points have more significant fusibility (case of melting), and for example, commodity plastics, such as polyethylene and polypropylene, may have a melt fluidity of 1 to 30 g/10 min and preferably 5 to 15 g/10 min.

As described above, the thickness of the bond between the molded paper product 40 and the molded plastic product 30 is 0.7 mm to 3.0 mm and preferably 0.8 mm to 2.0 mm. Examples of fibers in the molded paper product 40 include wood pulp, nonwood pulp, and recycled pulp, and examples of vegetable fibers include paper (pulp), bagasse (sugarcane), and bamboo. Among woody pulps, softwood (N material) has a fiber length of 2 mm to 4 mm, hardwood (L material) has a fiber length of about 1 mm, bagasse has a fiber length of about 0.8 mm to 2.8 mm, and bamboo has a fiber length of about 1.5 mm to 4.4 mm. A molded paper product 40 formed of a long-fiber material (fiber) is characterized by strength, whereas a molded paper product 40 formed of a short-fiber material is characterized by a fine texture. For infiltration welding to resin, as the fiber length increases, the resin that has infiltrated and solidified becomes less likely to come out, but the surface smoothness of the molded paper product 40 decreases, so that it is desirable to use a material with a mixture of long and short fibers, such as bamboo or bagasse, or use a mixture of a long-fiber material and a short-fiber material. In particular, the use of recycled paper as a short-fiber material improves environmental suitability. Although the density decreases with increasing long-fiber content, the density of the molded paper product 40 may be partially adjusted, for example, as described later. Thus, the density is described generally here as the density of the entire material (fiber) used for the molded paper product 40.

The density of the entire molded paper product 40 is desirably 0.6 g/cm$^3$ to 1.5 g/cm$^3$ and preferably 0.8 g/cm$^3$ to 1.2 g/cm$^3$. For the molded plastic product 30 having the spikes 63, in contrast to the rigidity of the resin, if the density of the molded paper product 40 is too high, the spikes 63 cannot pierce the molded paper product 40. If the density of the molded paper product 40 is too low, the spikes 63 (specifically, the resin) embedded in the molded paper product 40 cannot melt, and the welding may fail. In the embodiment above, since the molded plastic product 30 is welded to the inside of the molded paper product 40, if the molded paper product 40 has a low inside density, the molten resin easily infiltrates, and for a molded plastic product with spikes 63, the spikes 63 easily pierce the inside. In contrast, the outer surface of the molded paper product 40 is the outer surface of the cap 10, and the product is desired to have a smooth surface and be less likely to cause paper dust. In addition, as the density of the outer surface of the molded paper product 40, which is the outer surface of the cap 10, increases, the rigidity and antifouling property become higher. To increase the density of the outer surface of the molded paper product 40, for example, the outer surface of the molded paper product 40 is hot-pressed to pressurize the outer surface while evaporating water. This hot press increases the rigidity and density, resulting in an improvement in antifouling effects.

Regarding the surface roughness of the molded paper product 40, the molded paper product 40 had the uneven section of 40 mesh on the inner surface. The arithmetic mean height of surface roughness Sa defined in ISO was 27 μm on the outer surface of the molded paper product 40 and 35 μm on the inner surface. Likewise, the maximum height of surface roughness Sz was 171 μm on the outer surface of the molded paper product 40 and 288 μm on the inner surface. Likewise, the aspect ratio of surface texture Str was 0.45 on the outer surface of the molded paper product 40 and 0.09 on the inner surface. As the value of aspect ratio Str lowers, the directionality increases. Likewise, the calculated mean peak curvature of surface roughness Spc was 4.13/mm on the outer surface of the molded paper product 40 and 9.33/mm on the inner surface. A small value of arithmetic means curvature Spc means overall undulation, and a large value means thorniness. Likewise, the developed interfacial area ratio Sdr was 0.002 on the outer surface of the molded paper product 40 and 0.174 on the inner surface. The developed area ratio Sdr represents the area of the surface obtained by smoothing out the rough surface, and "0.174" means a 17.4% increase in area.

The spikes 63 melt when embedded in the molded paper product 40 as described above, and the molten spikes are smaller than their original shape. The outer peripheries of the spikes 63 are also welded to the molded paper product 40 in accordance with the shape of the horn H. Thus, as the number of spikes 63 on the molded plastic product 30 increases, the bond strength achieved by welding to the molded paper product 40 increases. However, the pressure by the horn H and the duration of the generation of ultrasonic vibration may also increase accordingly, so that the number of spikes may be determined based on productivity. For example, bond strengths with and without the spikes 63 were determined in bonding (welding) tests conducted between the molded plastic product 30 and the molded paper product 40 with the above cylindrical horn H under the conditions below.

Ultrasonic vibration frequency: 30 kHz
Inner diameter of horn H: 25 mm
Thickness of horn H: 3 mm
Pressure of horn H: 200 kPa
Duration of generation of ultrasonic vibration: 0.5 sec
Cooling time: 0.5 sec
Bond strength without spikes: 10 kgf
Bond strength with spikes: 15 kgf Under these conditions, for example, without the spikes 63, the depth of resin infiltrated into the fibers of the molded paper product 40 is desirably 0.1 mm to 0.2 mm in order to provide the bond strength to resist force in a direction of separating the welded molded plastic product 30 and molded paper product 40 from each other. When the relative rotation is also to be regulated, the depth of resin infiltrated into the fibers of the molded paper product 40 is desirably 0.2 mm to 0.3 mm in order to provide the bond strength. With the spikes 63, the depth of resin infiltrated into the fibers of the molded paper product 40 is desirably 0.3 mm to 0.4 mm in order to provide the bond strength to resist the force in the direction of pulling the welded molded plastic product 30 and molded paper product 40 away from each other. When the relative rotation is also to be regulated, the depth of resin infiltrated into the fibers of the molded paper product 40 is desirably 0.4 mm to 0.5 mm in order to provide the bond strength. The same effects as forming the spikes 63 on the molded plastic product 30 can be achieved by making cuts or scratch grooves in the inner surface of the molded paper product 40 with a knife or other tool during post-processing. The cuts increase the surface area of the inner surface of the molded paper product 40 (including the roughness on the inner surface) and molten resin enters the cuts to increase the amount of infiltrated resin. These effects increase the bonding strength. When cuts are made in the inner surface of the molded paper product 40, the energy needed for ultrasonic vibration becomes greater than in the case in which the spikes are formed. The increase in the ultrasonic vibration energy can be avoided by applying ultrasonic vibration only to the cuts to melt and infiltrate plastic.

As described above, for the cap 10 in each of these embodiments, since the molded plastic product 30 and the molded paper product 40 are welded together with a part of the former embedded in the latter to form the cap 10, the amount of resin used does not increase.

Furthermore, since the material of the molded paper product 40 accounts for more than 50% by mass of the entire cap 10, the product can meet demands for eco-friendliness.

The infiltration of a part of the molded plastic product 30 into the fibers of the molded paper product 40 can provide welding (bonding) strength between the molded plastic product 30 and the molded paper product 40 without increasing the amount of resin used.

The mesh-like uneven section 74 formed on the inner surface of the molded paper product 40 can increase the welding (bonding) strength between the molded plastic product 30 and the molded paper product 40.

The molded paper product 40 with the inside density lower than the outside density can increase the welding (bonding) strength between the molded paper product 40 and the molded plastic product 30 welded to the inside of the molded paper product 40 as well as can prevent paper dust on the outer surface of the molded paper product 40 and increase the antifouling properties.

The spikes (projections) 63 on the surface of the molded plastic product 30 facing the molded paper product 40 can pierce (enter) the molded paper product 40 to increase the welding (bonding) strength between the molded plastic product 30 and the molded paper product 40.

The spikes (projections) 63 can penetrate the molded paper product 40 to increase the welding (bonding) strength between the molded plastic product 30 and the molded paper product 40.

Furthermore, the molded plastic product 30 can partially be infiltrated into fibers through the recess 66 preformed in the molded paper product 40 to increase the welding (bonding) strength between the molded plastic product 30 and the molded paper product 40.

Figure 35:
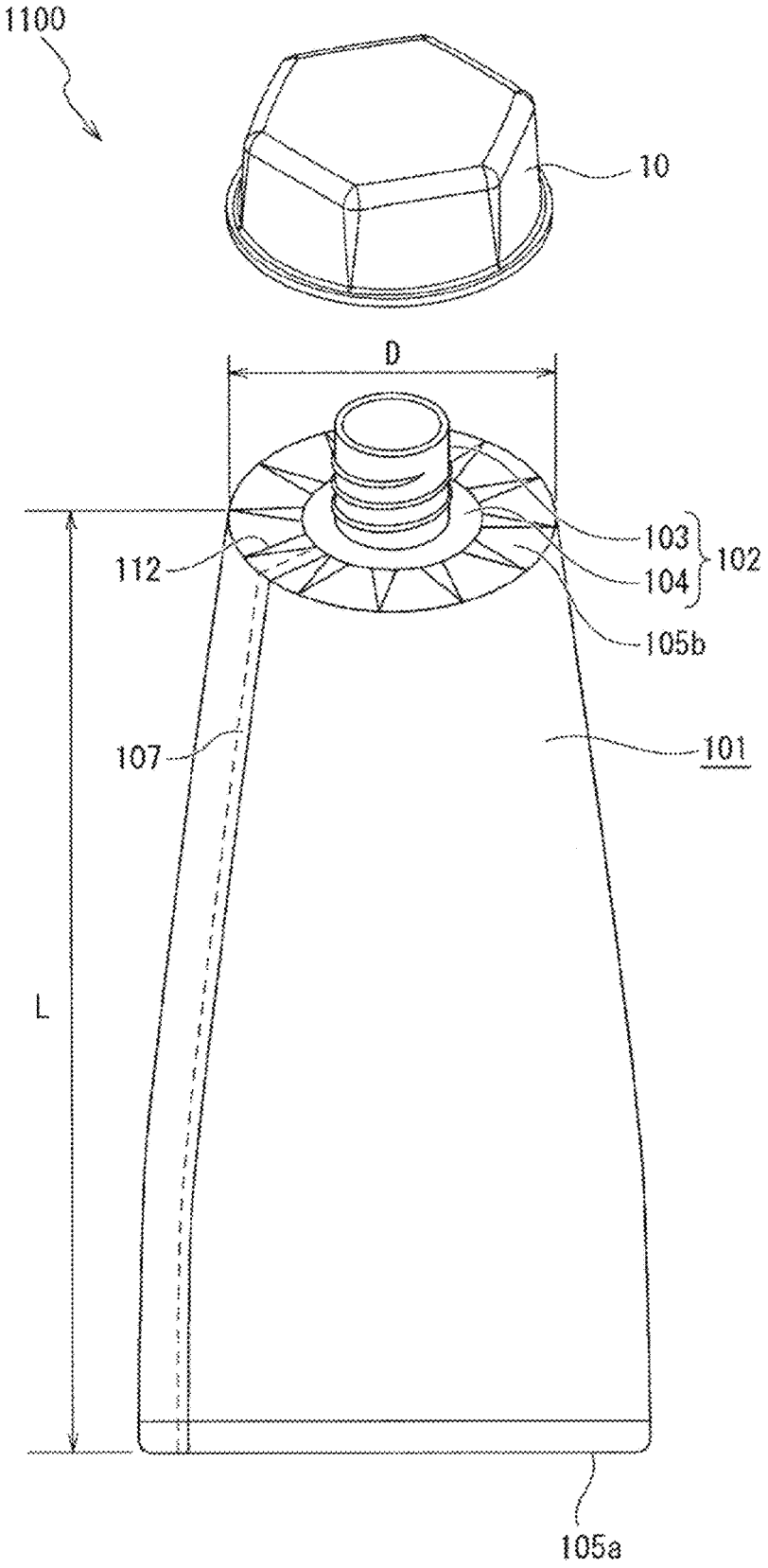
FIG. 35 is a schematic front view of a tube container according to the first embodiment.

(Description of Tube Container in FIG. 35 and Subsequent Figures)

Figure 36:
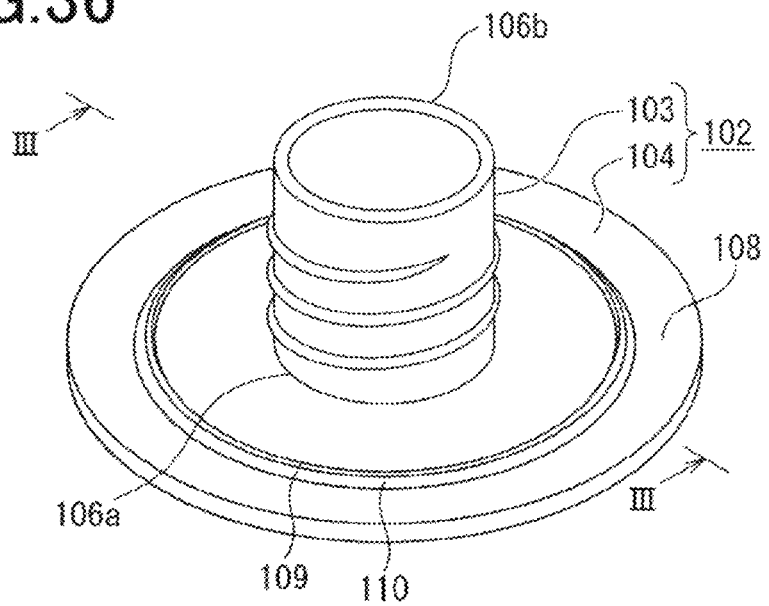
FIG. 36 is a perspective view of an outlet illustrated in FIG. 35.
Figure 37:
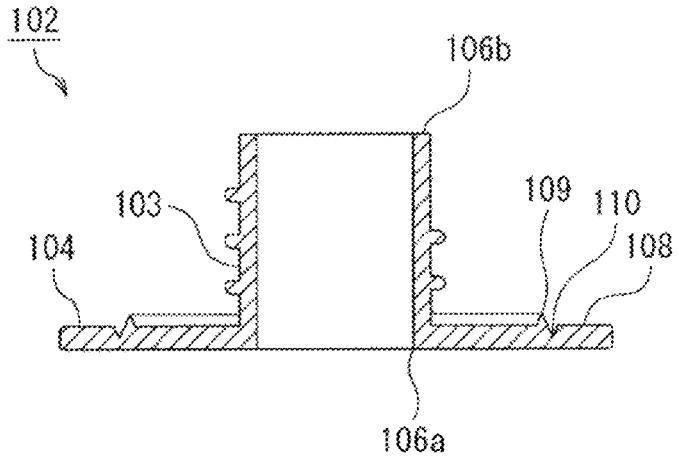
FIG. 37 is a cross-sectional view taken along line III-III in FIG. 35.

FIG. 35 is a schematic front view of a tube container according to the first embodiment, FIG. 36 is a perspective view of an outlet illustrated in FIG. 35, and FIG. 37 is a cross-sectional view taken along line III-III in FIG. 35. FIGS. 36 and 37 illustrate a state before the outlet is hermetically bonded to a body.

A tube container 1100 includes a tubular body 101 and an outlet 102 attached to the body 101.

The body 101 is a member for containing the contents and formed by shaping a sheet with a pair of substantially parallel edges into a tube. The body 101 has a tubular shape formed by, for example, butting and welding the inner surfaces of strip areas including the pair of edges of the sheet. The body 101 has a first end 105*a* (the lower end in FIG. 35) sealed and blocked. The body 101 also has a second end 105*b* (the upper end in FIG. 35) included in an area folded and hermetically bonded to an outer surface 108 of a flange 104 described later. The welding area between the body 101 and the flange 104 has a plurality of pleats 112 formed by folding the sheet of the body 101. The edges of the film are bonded together to form a bonded part 107 (backlining) on the body 101, which may be bent along the outer surface of the body 101 and bonded to the body 101. The bonded part 107 may be bonded to the body 101 by any method. For example, these parts may be welded together via a heat-sealing resin provided entirely or partially on the surface of the film of the body 101 or bonded together with an adhesive such as hotmelt. The way of bonding for the body 101 illustrated in FIG. 35 is illustrative only, and the outer surface of the strip area including one edge of the film of the body 101 may be bonded with the inner surface of the strip area including the other edge of the film.

Figure 38:
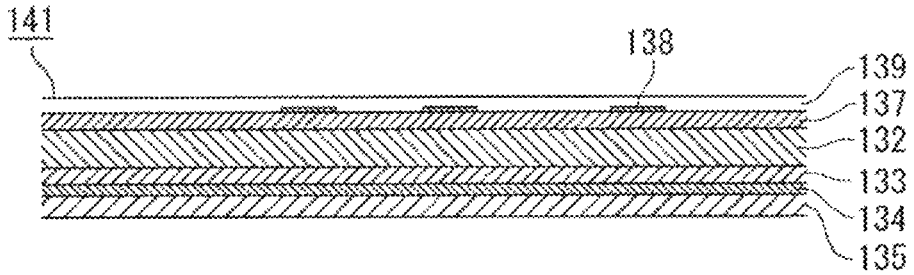
FIG. 38 is a cross-sectional view illustrating an example sheet forming the body of the tube container.

FIG. 38 is a cross-sectional view illustrating an example of the sheet of the body of the tube container. The body 101 of the tube container 1100 is composed of a sheet 141 formed mainly of paper. The sheet 141 is a multilayered sheet with a substrate film layer 133, a barrier layer 134, and a sealant layer 135 laminated in this order on one surface of a paper layer 132, with a paper protective layer 137 laminated on the other surface of the paper layer 132, and with an ink layer 138 and an overcoat varnish layer 139 laminated on the paper protective layer 137. Each layer is described in detail below.

(Paper Layer 132)

The paper layer 132 is a structural layer that provides strength and stiffness to the tube container 1100. Although the paper layer 132 may be formed of any type of paper, kraft paper or single-gloss kraft paper is preferable because such paper has strength, bending resistance, and printability. The paper layer 132 may also include paper such as waterproof paper, oilproof paper, or cup base paper as appropriate. The paper layer 132 is any paper containing at least 50% pulp fiber (cellulose fiber) and may be mixed paper including resin fiber in addition to pulp fiber.

The basis weight of the paper used for the paper layer 132 is 30 to 300 g/m$^2$ and preferably 50 to 120 g/m$^2$. When the basis weight of the paper used for the paper layer 132 is less than 30 g/m$^2$, the body 101 has insufficient stiffness. To compensate for the lack of stiffness, for example, a resin film provided inside the paper layer 132 is to be thickened. However, the thickening increases the proportion of resin and is undesirable in terms of lessening environmental impact. When the basis weight of the paper used for the paper layer 132 is more than 300 g/m$^2$, the stiffness and heat insulation of the paper deteriorate the tube-making (bag-making) characteristics, moldability, and weldability as well as manufacturing costs increase, so that such paper is not preferable.

(Substrate Film Layer 133)

The substrate film layer 133 is a layer that provides the sheet 141 with heat resistance and physical strength such as toughness. The substrate film layer 133 is also a layer serving as a substrate for the barrier layer 134. Although the film of the substrate film layer 133 may be formed of any material, a stretched film of polypropylene, polyester, or polyamide is preferably used in terms of heat resistance and physical strength. However, the substrate film layer 133 may also be formed of paper.

(Barrier Layer 134)

The barrier layer 134 is a functional layer that improves the preservation of the contents by blocking oxygen and water vapor. The barrier layer 134 may be, for example, one or more of a vapor-deposited film of an inorganic compound such as silica or alumina, an evaporated metal film such as aluminum, metallic foil such as aluminum, a plate-like mineral, and/or a coating film of a barrier coating agent containing barrier resin. The barrier resin used for the barrier coating agent may be, for example, an ethylene-vinyl alcohol copolymer (EVOH) or polyvinylidene chloride (PVDC), and the barrier coating agent contains a binder resin in addition to the barrier resin as appropriate. The barrier layer 134 may be laminated in advance on the substrate film layer 133 to form a barrier film or provided as a monolayer film.

(Sealant Layer 135)

Although the sealant layer 135 may be formed of any material, a thermoplastic resin such as polypropylene, polyethylene, cyclic polyolefin, or polyester is preferable. The sealant layer 135 is a resin having a softening temperature at least 20° C. lower than the softening temperature of the substrate film layer 133. When the softening temperature of the sealant layer 135 is not at least 20° C. lower than the softening temperature of the substrate film layer 133, the substrate film layer 133 is likely to soften during sealing and produce pinholes. This is not preferable. The softening temperature of the sealant layer 135 is preferably at least 40° C. lower than the softening temperature of the substrate film layer 133.

Although the sealant layer 135 may be formed of any thermoplastic resin adhesive to the thermoplastic resin used as the material for the outlet 102 described later, the former thermoplastic resin is preferably the same material as the thermoplastic resin used for the outlet 102. When the thermoplastic resin used for the sealant layer 135 is the same as the thermoplastic resin layer used for the outlet 102, the sealing strength between the body 101 and the outlet 102 can be improved.

(Paper Protective Layer 137)

The paper protective layer 137 is a layer for preventing dirt and the contents from adhering to the paper layer 132 included in the sheet 141. The paper protective layer 137 may be formed of any material and by any method. The paper protective layer 137 may be laminated by extrusion coating of thermoplastic resin or coating of a coating agent such as a waterproof agent or an oilproof agent. The thickness of the paper protective layer 137 is preferably 0.2 to 50 μm and more preferably 1 to 20 μm. When the thickness of the paper protective layer 137 is smaller than 0.2 μm, the paper protective layer 137 may produce pinholes, resulting in insufficient protection of the paper layer 132. A thickness of the paper protective layer 137 greater than 50 μm is not preferable in terms of the amount of resin used and manufacturing costs.

(Ink Layer and Overcoat Varnish Layer)

The ink layer 138 is a layer provided by printing for various indications, and the overcoat varnish layer 139 is a layer that provides, for example, abrasion resistance. The order of stacking the ink layer 138 and the overcoat varnish layer may be reversed from FIG. 38. The overcoat varnish layer 139 may also serve as the paper protective layer 137.

The thickness (total thickness) of the sheet 141 included in the body 101 is not limited to a particular value, but preferably 30 to 300 μm. The thickness of the film of the body 101 within the above range allows the body 101 to be easily processed into a tubular shape with a pouch making machine or a pillow stick packaging machine. Because the paper layer 132 provides strength and stiffness, the film may be thinner than typical laminate tubes (300 to 500 μm thick) and allow the amount of resin used to be reduced.

To lower the percentage of resin in the sheet 141 of the body 101, the paper layer 132 preferably accounts for 50% or more of the mass of the sheet 141. From the viewpoint of reducing the amount of resin used, the paper layer 132 preferably accounts for a higher percentage.

The body 101 may be any sheet as long as at least the sealant layer 135 is laminated on one side of the paper layer 132 (the inside surface of the tube container 1100), and one or more of the substrate film layer 133, the barrier layer 134, the paper protective layer 137, the ink layer 138, and the overcoat varnish layer 139 may be omitted.

Referring again to FIGS. 35 to 37, the outlet 102 is a spout for discharging the contents of the body 101 and includes a cylindrical, tubular portion 103 and the flange 104. The flange 104 is a flat portion connected to one end 106*a* of the tubular portion 103 (the lower end in FIG. 35) and extending outward from the tubular portion 103. In the present embodiment, the flange 104 extends in directions orthogonal to the axial direction of the tubular portion 103 (in horizontal directions in FIG. 35). Although the flange 104 in the present embodiment is annular, the flange 104 may have any shape to which the body 101 can be joined, such as an ellipse, an oval, a track, or a polygon.

The outlet 102 is formed of materials including a thermoplastic resin and a filler other than resin. The thermoplastic resin used in the materials for the outlet 102 may be, for example, any one or a combination of two or more of polyethylene, polypropylene, polyester, polyamide, and cyclopolyolefin. The filler may be any one or a combination of two or more of talc, kaolin, paper dust, and cellulose fiber. The use of a mixture of the thermoplastic resin and the filler other than resin as the materials for the outlet 102 enables the amount of resin used to be reduced while keeping the moldability and the thermal weldability to the sheet material of the body 101. The outlet 102 may be formed by any method, such as injection molding, thermoforming such as vacuum forming or hot plate pressure forming, compression molding, or another known forming method.

As illustrated in FIGS. 36 and 37, the flange 104 has an annular ridge 109 and an annular groove 110 provided on the outer surface 108 (the surface facing an end 106*b* of the tubular portion 103). When the body 101 is welded to the flange 104 of the outlet 102, the ridge 109 melts first, and the molten resin spreads between the inner surface of the body 101 and the flange 104. The molten resin also flows partially into the groove 110. As a result, the inner surface of the body 101 and the outer surface 108 of the flange 104 can be surface welded together via the molten resin of the ridge 109 to improve the welding strength. The outlet 102 according to the present embodiment contains the filler other than resin, which tends to reduce the welding strength between the body 101 and the outlet 102. However, the ridge 109 and the groove 110 can ensure sufficient welding strength. The ridge 109 and the groove 110 are not limited to a particular number, and two or more ridges and grooves may be provided. The ridge 109 and the number of grooves 110 grooves may not be equal in number, but for example, two grooves 110 may be provided inside and outside a single ridge 109. The groove 110 may not be provided.

The height of the ridge 109 (the height from the outer surface 108 of the flange 104) is 0.05 to 2 mm and more preferably 0.1 to 1 mm. When the height of the ridge 109 is less than 0.05 mm, the welding strength cannot be improved. When the height of the ridge 109 is more than 2 mm, the ridge 109 does not completely melt during welding to the body 101 and remains as a step on the outer surface 108 of the flange 104, causing leakage of contents.

The depth of the groove 110 (the depth from the outer surface 108 of the flange 104) is 0 to 2 mm and preferably 0 to 1 mm. When the ridge 109 is low, the groove 110 may not be formed. The depth of the groove 110 more than 2 mm is not preferable because the strength of the flange 104 may lower or the appearance after welding to the body 101 may be poor.

In the process of producing the tube container 1100, although the body 101 and the outlet 102 may be joined together by, for example, ultrasonic welding, high frequency welding, heat-seal welding, hot-air welding, or body insert compression molding, the use of ultrasonic welding is preferable because ultrasonic welding is less affected by the thermal insulation properties of paper.

If the tube length of the tube container 1100 is denoted by L and the tube bore is denoted by D, L/D is preferably in the range of 1 to 10 and more preferably in the range of 1.5 to 8. As illustrated in FIG. 35, the tube length L is the axial length between the end 105*a* and the site of welding to the flange 104, and the tube bore D is the diameter of the flange 104 when the flange 104 is circular. When the flange 104 is elliptic, the tube bore D is (A+B)/2 (where A denotes the length of the major axis of the ellipse, and B denotes the length of the minor axis of the ellipse). When the value of L/D is smaller than 1, the tube length L is too short for the tube bore D, and the shape of the tube container 1100 is unsuitable for a package container. When the value of L/D is greater than 10, the tube length L is too long for the tube bore D and accordingly deteriorates the appearance of the tube container 1100, and the shape of the tube container 1100 is unsuitable for a package container.

As illustrated in FIG. 35, the tube container 1100 may further include a cap (screw cap) 10 that can be removably screwed onto the tubular portion 103 of the outlet 102. The cap 10 has the same configuration as described in the above embodiments. The amount of paper used is preferably determined to account for more than 50% by weight of the overall package container of the cap 10, the outlet 102, and the body 101.

When the tube container 1100 includes the cap 10, the tube container 1100 can be easily resealed after being opened.

The tube container 1100 may include a hinge cap in place of the screw cap 10. When a hinge cap is attached to the outlet 102, the hinge cap may be screwed onto the tubular portion 103 illustrated in FIG. 35. Alternatively, the thread on the outer surface of the tubular portion 103 may be replaced with a rib to attach a hinge cap to the outlet 102 by fitting with the rib.

The end 106*b* of the tubular portion 103 may be sealed with a film that closes the tubular portion 103 when the tube container 1100 is unopened.

Furthermore, the interior of the tubular portion 103 may be closed by a partition to keep the interior of the container sealed when the tube container 1100 is unopened. The partition preferably has a circular half-cut along the inner periphery of the tubular portion 103 and a pull-ring connected to the site surrounded by the half-cut. With this structure, when opening the tube container 1100, the user can pull the pull-ring to break the half-cut in the partition to remove the part of the partition surrounded by the half-cut. This removal forms an opening for feeding the contents from the body 101 to the tubular portion 103.

As described above, in the present embodiment, the body 101 is composed of a sheet including paper and a sealant, the outlet 102 is formed of materials including a thermoplastic resin and a filler other than resin, and the paper has the highest mass percentage of the total mass of the materials for the body 101 and the outlet 102. For conventional resin tube containers, when the resin layer in the sheet of the body is simply thinned, the stiffness of the body becomes insufficient, reducing the self-supporting and handling properties of the tube container. In contrast, in the present embodiment, the use of paper as the structural material for the body 101 can reduce the amount of resin used and provide stiffness to the body 101. Furthermore, the addition of the filler other than resin to the molding material for the outlet 102 can also reduce the amount of resin used for the tube container 1100. Accordingly, the tube container 1100 provided in the present embodiment contains a smaller amount of resin than before and has stiffness needed for the self-supporting and handling properties of the container. In addition, the basis weight of the paper used for the body 101 that is less than 300 g/m$^2$ allows smooth accomplishment of a rounding process and welding of the bonded part 107 during formation of the body 101 as well as the process of folding the area near the end 105*b* of the body 101 and the process of welding the area near the end 105*b* of the body 101 to the flange 104 during attachment of the body 101 to the outlet 102, thus achieving good formability by a processing machine.

In the tube container 1100 according to the present embodiment, the flange 104 has a flat shape orthogonal to the central axis of the tubular portion 103, with the body 101 welded to the outer surface 108 of the flange 104. In this structure, if the contents of the tube container 1100 are low, the contents can be easily squeezed out by folding the body 101 along the outer periphery of the flange 104. With the flange 104 being flat, the flange 104 does not create a space in which the contents remain. Accordingly, the contents can be squeezed out without any residue by bending the body 101 along the outer periphery of the flange 104 so that the flange 104 and the body 101 are substantially flat.

The tube container according to the present embodiment is described below.

[1] A tube container comprising:

a tubular body comprising a sheet including paper and a sealant with a first end of the tubular body blocked; and an outlet comprising materials including a thermoplastic resin and a filler being a material other than resin, the outlet being attached to a second end of the body, wherein the paper has a basis weight of 30 to 300 g/m$^2$, and the paper has the highest mass percentage of the total mass of the materials for the body and the outlet.

[2] The tube container according to item [1], wherein the thermoplastic resin included in the outlet is at least one selected from polyethylene, polypropylene, polyester, polyamide, and cyclopolyolefin, and the filler is at least one selected from calcium carbonate, talc, kaolin, paper dust, and cellulose fiber.

[3] The tube container according to item [1] or [2], wherein the thermoplastic resin included in the outlet and the sealant included in the sheet of the body are the same material.

[4] The tube container according to any one of items [1] to [3], wherein the outlet includes a cylindrical, tubular portion, and a flat flange connected to one end of the tubular portion and extending outward from the tubular portion and in directions orthogonal to the axial direction of the tubular portion, and the body has, near the second end, an inner surface joined to one of both surfaces of the flange, the surface facing the other end of the tubular portion.

<Second Embodiment of Tube Container>

Tube containers including paper as part of their materials have not been sufficiently studied. For example, the body of a tube container may be formed of a sheet material and may thus be composed of a sheet formed mainly of paper. However, if the shoulder (spout) is formed of plastic, the proportion of plastic in the tube container becomes high, and the tube container would have to be disposed of as plastic, making it difficult to reuse the tube container as a paper resource.

Feature of Embodiment

According to a feature of this embodiment, for example, as illustrated in FIG. 35, the tube container 1100 includes the cap 10. The tube container 1100 includes the tubular body 101 with the first end blocked and the outlet 102 attached to the second end of the body 101, and the body 101 is formed mainly of paper.

Advantageous Effects of Feature of Embodiment

The present embodiment provides a paper tube container composed of a sheet formed mainly of paper and containing a smaller amount of resin than before.

Although the cap and the tube container including the cup according to the embodiments have been described, the present invention is not limited to the configuration described in the above embodiments but may be modified variously within the scope and spirit of the present invention. For example, when the cap 10 is formed, the support A and the horn H used for the ultrasonic welding between the molded plastic product 30 and the molded paper product 40 may be adapted to the actual members.

[Reference Signs List] 10 Cap; 20 Container; 21 Mouth; 30 Molded plastic product; 40 Molded paper product; 50 Lid; 50*a* Opening; 50*b* Top surface; 51 Screwed portion; 52 Stopper; 53 Rib; 57 Slope; 58 Recess; 59 Surface; 60 Joining section; 60*a* End surface; 61 Protrusion; 62 Hinge; 63 Spike (projection); 64 Connector; 65 Projection; 66 Recess; 69 Receiving section; 70 Cylindrical portion; 71 Opening; 72 Top portion; 73 Flange; 74 Uneven section; 75 Recess; 81 Side plate; 82 Paper tube; 90 Torque distributor; 91 Reservoir; 92 Reservoir; 93 ED; a Fall prevention section; 101 Body; 102 Outlet; 103 Tubular portion; 104 Flange; 105*a*, 105*b* End; 106*a*, 106*b* End; 132 Paper layer; 135 Sealant layer; 141 Sheet; 1100 Tube container.

What is claimed is:

1. A cap fittable over a mouth of a container, the cap comprising:

a molded plastic product; and a molded paper product comprising paper as a primary material and joined to the molded plastic product, wherein the molded plastic product comprises a lid configured to open and close the mouth;

a joining section, to which the molded paper product is joined;

a receiving section joined to the joining section and a cylindrical portion extending from the receiving section;

the joining section is a plate having a shape of a regular polygon, the receiving section has a shape of a regular polygon identical to the shape of the joining section, and the cap has a shape of a polygonal prism including the receiving section and side plates standing on sides of the regular polygon;

the lid is cylindrical with an internal thread cut in an inner surface of the lid to correspond to an external thread cut on an outer surface of the mouth or cylindrical with an external thread cut on an outer surface of the lid to correspond to an internal thread cut in an inner surface of the mouth, the lid is bonded to a central position of the joining section with an axis of the lid extending in a direction orthogonal to a surface of the joining section;

the joining section is bonded to a first end of the lid, the first end of the lid is opposite a second end of the lid, the second end of the lid opens and closes the mouth and used to join to the molded paper product.

2. The cap of claim 1, wherein:

the material of the molded paper product accounts for more than 50% by mass of total materials for the cap.

3. The cap of claim 1, wherein the surface of the joining section has (i) a half-round recess positioned at a center the surface of the joining section and (ii) a slope surrounding the half-round recess and declining toward the half-round recess.

4. The cap of claim 3, wherein the joining section and the receiving section are joined together with an adhesive.

* * * * *